US005860766A

United States Patent [19]

Lochtefeld et al.

[11] Patent Number: 5,860,766

[45] Date of Patent: Jan. 19, 1999

[54] BOAT ACTIVATED WAVE GENERATOR

[75] Inventors: Thomas J. Lochtefeld, La Jolla; Charles E. Sauerbier, Arroyo Grande, both of Calif.

[73] Assignee: Light Wave, Ltd., Reno, Nev.

[21] Appl. No.: 769,695

[22] Filed: Dec. 18, 1996

Related U.S. Application Data

[63] Continuation of Ser. No. 475,092, Jun. 7, 1995.

[51] Int. Cl.[6] ..... E02B 3/00; B63B 35/79

[52] U.S. Cl. ..... 405/79; 114/253; 405/52; 441/65; 472/128

[58] Field of Search ..... 405/79, 52; 114/253; 441/74, 65; 4/291; 472/128

[56] References Cited

U.S. PATENT DOCUMENTS

| | | | |
|---|---|---|---|
| Re. 25,165 | 5/1962 | Pulsifier . | |
| 799,708 | 9/1905 | Boyce . | |
| 2,414,480 | 1/1947 | Morrill . | |
| 2,815,951 | 12/1957 | Baldanza . | |
| 2,983,508 | 5/1961 | Modine . | |
| 3,085,404 | 4/1963 | Smith . | |
| 3,101,691 | 8/1963 | Wendt . | |
| 3,139,055 | 6/1964 | Nutting | 441/65 X |
| 3,638,598 | 2/1972 | Viad . | |
| 3,688,730 | 9/1972 | Ortlieb et al. | 114/253 X |
| 3,802,697 | 4/1974 | Le Mehaute | 405/79 X |
| 3,913,332 | 10/1975 | Forsman | 405/79 |
| 3,981,612 | 9/1976 | Bunger et al. . | |
| 4,437,842 | 3/1984 | Connor | 441/65 |
| 4,484,534 | 11/1984 | du Boullay . | |
| 4,507,094 | 3/1985 | Hennebutte . | |
| 4,662,781 | 5/1987 | Tinkler . | |
| 4,792,260 | 12/1988 | Sauerbier . | |
| 4,954,014 | 9/1990 | Sauerbier et al. . | |
| 5,000,110 | 3/1991 | Moore . | |
| 5,171,101 | 12/1992 | Sauerbier et al. . | |
| 5,178,090 | 1/1993 | Carter | 114/253 X |
| 5,236,280 | 8/1993 | Lochtefeld . | |
| 5,263,430 | 11/1993 | Monfort . | |
| 5,362,269 | 11/1994 | Leach | 441/65 |
| 5,447,459 | 9/1995 | Hammond | 441/65 X |
| 5,482,485 | 1/1996 | Ball | 114/253 X |
| 5,549,071 | 8/1996 | Pigeon et al. . | |

FOREIGN PATENT DOCUMENTS

| | | |
|---|---|---|
| 1019527 | 10/1952 | France . |
| 52-41392 | 3/1977 | Japan . |
| 1090262 | 2/1965 | United Kingdom . |

OTHER PUBLICATIONS

Hornung/Killen, "A Stationary Oblique Breaking Wave for Laboratory Testing of Surfboards", Journal of Fluid Mechanics,(1976), vol. 78, Part 3, pp. 459–484.

Killen, P.D., "Model Studies of a Wave Riding Facility," 7th Australasian Hydraulics and Fluid Mechanics Conference, Brisbane (1980).

Killen/Stalker, "A Facility for Wave Riding Research," 8th Australasian Fluid Mechanics Conference, University of Newcastle, N.S.W. (1983).

*Primary Examiner*—Dennis L. Taylor
*Attorney, Agent, or Firm*—Dickinson Wright PLLC

[57] ABSTRACT

The present invention is a boat activated wave generating device for use in a body of water. The wave generating device preferably has wave forming sections that help to create wave shapes and wake formations upon which surfing and/or other skimming maneuvers can be performed. The wave forming sections are moved by the boat and have forward leading edges and upper flow forming surfaces. The device can be pivotally connected to the boat and pulled, or directly attached to the side of the boat hull. In operation, the device is moved through the water such that the forward leading edges are submerged to lift water onto the flow forming surfaces. Water flowing on and conforming to the surfaces is directed relatively upwardly and/or laterally across the surfaces, to create various wave shapes and wake formations thereon.

20 Claims, 9 Drawing Sheets

Top View

3/4 View

Side View

Side View

Bottom View

Front View

Front View

3/4 View

BOAT ACTIVATED WAVE GENERATOR

RELATED APPLICATIONS

This application is a continuation in part of U.S. application Ser. No. 08/475,092, filed Jun. 7, 1995.

FIELD OF THE INVENTION

The present invention relates to a generator for forming waves, and in particular, to a generator activated by a boat in a deep water environment.

BACKGROUND OF THE INVENTION

Surfing, as a sport, has attracted enthusiasts all over the world, and many of them travel long distances to locations where ideal surfing conditions exist. Particularly prized by expert surfers are "barreling" or "pipeline" style waves, that is, waves which move with sufficient velocity and height that, when they encounter an upwardly sloping bottom of certain configuration, curl forward over the advancing base of the wave to form a tunnel shape. Expert surfers can ride inside or at the mouth of the wave formation and move laterally across the face of the wave, while seeking to keep pace with the formation of the tunnel without being caught in the collapsing portion thereof.

The formation of such ideal waves under natural conditions requires a comparatively rare combination of factors, including wind of a certain constancy of velocity and direction, and waves of a certain velocity, direction and height, approaching a shore having a certain bottom slope and configuration. Very few locations in the world have such favorable conditions and combination of characteristics. Even in those areas where favorable land and water conditions exist, the most favorable surfing conditions may occur only during limited times of the year and only during ideal weather conditions. For these reasons, surfing has become a sport which eludes most individuals, and all but the most dedicated and enthusiastic surfers rarely have an opportunity to surf an ideal tunnel wave. Those that do, including most expert surfers, typically have to travel thousands of miles to reach ideal surfing locations, many of which are in remote areas.

Recently, sheet wave water rides, such as those known as the Flow-Rider™, have emerged to provide even the most inexperienced surfer an opportunity to ride a wave. These water rides, which simulate a substantially perfect wave, have become popular and have been installed at a number of water amusement parks. Individuals no longer have to travel thousands of miles to experience the thrill of surfing. Nevertheless, at the present time, such water rides have only been installed at limited locations, and because they are extremely popular, people generally have to wait in long lines to be able to participate. This makes it not only difficult to ride the water ride, but also to practice and learn the skills necessary to become an expert surfer.

Recent developments in water sports activities has also seen an increasing popularity in the sport of wake-boarding, which is an off-shoot of the sport of water skiing. Wake-boarders are pulled behind a boat in much the same manner as water skiing. The wake-board and the wake-boarders' maneuvers, however, are more akin to those of surfing and snowboarding. Wake-boarders make use of the wake of the boat as a ramp on which to launch a maneuver. The size and shape of the wake are an integral part of the wake-boarders sporting canvas. At the present time, other than modifying the ballast and trim of the wake-generating boat, nothing exists to improve the boat's wake, or, generate a new and enhanced wake-like wave.

What is needed, then, is a wave generating device that can be operated at virtually anytime at almost any suitable location. This need is satisfied by a boat activated wave generating device capable of forming surfable and/or wake-boardable waves thereon, which can be operated and powered by a boat.

SUMMARY OF THE INVENTION

The present invention represents a substantial improvement over prior wave generating devices in that the present invention is boat activated and can be used at the convenience of the operator.

The present invention is a wave generating device which extends from or is otherwise attached to a motor boat. It can be extended substantially laterally from the boat hull or can be pivotably connected to the rear of the boat and pulled. The embodiment that is pulled is preferably buoyant so that it can float in the water on its own but not necessarily so as will be discussed.

In operation, the device is moved through a body of water to cause water to flow onto and/or over the device and to form wave shapes and enhanced wakes upon which surfing and/or wake-boarding maneuvers can be performed. The boat causes the device to move through the body of water, pushing and lifting water onto and/or over and/or across the device, to form wave shapes and other wake formations thereon. Surfing and other skimming maneuvers can, with sufficient skill, be performed on the waves. Wake boarding maneuvers can also be performed, using a tow rope behind the boat, on wakes that are created and/or enhanced by the wave generating device.

In the preferred embodiments, the overall configuration is substantially in the shape of a triangle from above, formed by a forward extending center portion and two laterally extending wave forming sections. The triangulation of the device causes the device to self-align during operation as hydrodynamic forces act on the device. The device is preferably symmetrical in shape from above, although not necessarily so, and pulled from the center portion, so that hydrodynamic forces acting on the device on either side are substantially equalized, which helps to keep the device stable. In the embodiment that is attached to the side of the boat, the device is similarly extended in triangular fashion, using the boat as the center from which the laterally extending wave forming sections extend.

Each of the embodiments of the wave generating device preferably has wave forming sections extending substantially laterally in relation to the boat. The sections each preferably have a substantially laterally oriented forward leading edge portion that is angled rearward relative to the direction of travel to help lift water onto the device. The forward leading edge portion, which is preferably rounded to avoid injury, is adapted to cut through the water slightly below the surface to lift water onto the device. The wave forming sections also each have an upper flow-forming surface preferably extending laterally, rearwardly and upwardly. The flow-forming surfaces are preferably curved and help to force water flowing onto the device upwardly and/or laterally to create the desired wave shapes.

In the preferred embodiment, the flow forming surfaces are concave and have curvature in both horizontal and vertical directions to allow water to flow onto and substantially across the surfaces and substantially conform thereto to create the desired tunnel wave shapes. For example, to form tunnel wave shapes, the upper flow-forming surfaces are curved and concave in shape, not only vertically, but also horizontally, so that a theoretical infinitesimal body of water, moving along the face of the surfaces, encounters a force, which is not only vertical, but also lateral, as it travels along its face. The angle at which the flow forming surfaces are oriented in relation to the direction of travel, which can be anywhere from as little as 5 degrees to as high as 70 degrees, but preferably about 20 to 50 degrees, also causes the water to flow not only upward, but also laterally, across the face of the surfaces. This force, or pressure field, accelerates the water, forcing it not only upward and forward, but laterally, above the surrounding body of water, whereafter, the force of gravity can overcome its upward and forward momentum and cause it to fall in a curving arc, back to the base of the advancing wave. If the forward speed of the water relative to the flow-forming surface is sufficient, its path will form a substantial loop. Under ideal circumstances, the wave generating device will pare and lift a sheet flow of water upward as it moves forward, resulting in the creation of a tunnel wave shape, at the mouth of or within which a rider can maneuver and perform surfing maneuvers thereon.

In the preferred embodiment, there are two wave forming sections, which are connected to and preferably transition laterally at an angle rearward from, the center portion in the shape of a V from above. The wave forming sections are preferably substantially identical, but opposite facing, one on either side of the center portion, so that two wave shapes, extending in opposite directions, can be created on either side of the device. In other embodiments, however, the wave forming sections and flow-forming surfaces can have different configurations, including complex shapes, and, as in one of the alternate embodiments, the shape of a bulbous hull or torpedo, which pushes water upwardly and/or laterally, rather than scooping it up, to form more simple wave shapes and enhanced wakes thereon. In this respect, it is important to note that the present invention contemplates that the wave forming sections and flow-forming surfaces can be in virtually any configuration that achieves the desired results.

It is important, although not critical, that the device remain at a substantially constant depth in the water to allow a steady flow of water to be lifted onto the wave forming sections. This helps to create a consistent flow of water on the device and therefore consistent wave formations and enhanced wakes. Several factors are taken into consideration to help ensure that a substantially constant depth is maintained. In the preferred embodiment, the device itself can help keep the device in substantial hydrodynamic equilibrium. That is, the design takes into consideration the hydrodynamic forces acting on the device to help stabilize it during operation. For example, to remain in substantial equilibrium, the upward forces created by the buoyancy of the device and its ability to plane over the water can be countered by the downward forces created by the weight of the device and its ability to lift water which creates a reciprocal downward force on the front end. These counteracting forces help to prevent the device from undesirably cutting or diving too deep into the water, and/or excessively skimming or planing over the water, both of which will adversely affect the formation of the wave shapes.

In the embodiments that have a pivoting connection, the connection to the boat, which is substantially fixed in lateral directions, also helps keep the device stable in the water. By fixing the joint in lateral directions, the position of the device in relation to the boat, in vertical and horizontal directions, can be maintained substantially fixed. Accordingly, in this manner, the depth at which the device moves through the water can be maintained in substantial equilibrium, provided that the back end of the boat can be stabilized in the water. Because the hydrodynamic forces acting on the boat tend to affect the front end more than the back end, thus allowing the back end to remain substantially stable in the water, by connecting the device to the back end of the boat, the device can be stabilized in relation to the water, such that the device and therefore the leading edges of the wave forming sections, can be maintained at a substantially constant depth. The horizontal position of the device in relation to the boat can also be maintained in this manner. In the embodiment attached to the boat hull, the boat itself helps to keep the device at a substantially constant depth in the water.

In the preferred embodiment, the pivoting connection preferably allows the boat and device to flexibly rotate independently with respect to each other, about a substantially fixed joint, in at least one or more of the horizontal, vertical and torsional directions, to help the boat and device maneuver through the water. The connection is also preferably removable to allow the device to be easily attached and removed from the boat which makes the device portable. Horizontal pivoting allows the device to rotate horizontally, as necessary, so that the device can follow immediately behind the boat, in the line of travel, to help the boat and device maneuver around turns. It also allows the wave forming sections of the device, which preferably extend laterally outward further than the width of the boat, to be in open water. Vertical pivoting allows the device to flexibly rotate in relation to the boat, which can be helpful in keeping the device substantially level in the water. When a boat accelerates or travels through rough water, the boat can plane or skim over the water, causing the front end of the boat to move up and down. By pivotally connecting the device to the back of the boat, which typically remains more stable in the water, the device can be maintained in substantial equilibrium, substantially unaffected by the movement of the boat's front end. Torsional pivoting allows the boat and device to act independently from one another in the torsional direction, which can be helpful around sharp turns. The preferred device is generally wider and has a relatively flatter base than the boat, and therefore, does not lean as much around sharp turns as do boats. Accordingly, when a boat pulling the device leans into a sharp turn, the torsional pivoting enables the boat to lean independently from the device, allowing the device to remain substantially level in the water. Even around sharp turns, therefore, the connection allows the device to remain in substantial equilibrium in the water.

In the preferred embodiment, the center portion, which forms a substantial V shape from above, is preferably connected to the boat far away enough from the back of the boat to allow the device to pivot freely. The center portion is preferably relatively flat in configuration, or in the shape of a flat wedge, and extends relatively rearward at an angle on both sides from the apex of the device. The water immediately behind the boat is often turbulent due to the propeller and the egress of water from underneath the boat, and therefore, is generally undesirable for riding purposes as described in the preferred embodiment. In the preferred embodiment, the relatively flat configuration of the center portion is adapted to cut through the water behind the boat to help to stabilize the device by directing that water rearward.

The hydrodynamic forces acting on the center portion also help to maintain it substantially level in the water during operation. In the preferred embodiment, some of the water behind the boat is permitted to flow substantially over the center portion by having it positioned slightly below the water surface behind the boat. In such case, water flowing over the center portion is channeled rearward between the wave forming sections, which are connected to the center portion, to help self-align the device horizontally in the water. Water behind the boat can also be permitted to flow substantially under the center portion, as in an alternate embodiment, so that it skims or planes over the water. In such case, water is also channeled rearward under the center portion between the wave forming sections to provide stability to the device. The wave forming sections, however, in such case, must be positioned slightly lower in relation to the center portion so that they can pare water upward on either side to create the proper wave shapes. It is important to note that the present invention contemplates using devices having substantially different overall configurations, including center portions having different shapes and relative positions, and is not limited by the specific embodiments disclosed. The center portion also helps guard the propellers to help prevent accidental injuries.

The portion of the wave forming section that actually lifts water onto the device is the forward extending leading edge portion which preferably starts at the wave forming section's lowest elevation and extends along the outermost forward part of the section. The leading edge portion can, in the preferred embodiment, be wedge shaped and laterally oriented, extending ahead of the flow forming surfaces at an angle rearward. The lowest elevation's leading edge portions, however, are preferably slightly rounded in cross section so that they do not cause injury to the riders. During operation, the leading edge portions are positioned below the water surface so that they are submerged, preferably at a substantially constant depth, to enable a substantially constant amount of water to be lifted onto the wave forming sections. This helps to ensure that consistent wave shapes and wakes are formed, The factors involved in helping to keep the leading edge at a substantially constant depth in the water include, but are not limited to, those already discussed above, i.e., the weight and buoyancy of the device, the tendency of the device to plane over the water, the ability of the device to lift water upward, the reciprocal downward force on the front end caused by lifting water upward, the width of the device, the connection to the boat, etc., as well as the water conditions and the speed of the boat. All of these factors can be taken into consideration in the design of the present invention to help ensure that the leading edge performs in the intended manner.

The spacing of the wave forming sections on either side of the center portion is a function of the desired water effects and the boat being used. In the preferred embodiment, to ensure that very little turbulent water immediately behind the boat is encountered by the wave forming sections, the spacing is preferably far enough apart so that the wave forming sections are substantially in open water during operation, and reciprocally, most of the turbulent water is directed rearwardly through the center portion. The spacing of the sections can also contribute to the ability of the device to remain substantially level in the water. The wider the sections are spaced apart, the wider the stance and support base of the device, and therefore, the better the lateral stability of the device.

The preferred embodiment can be adapted to be relatively wide or narrow, or somewhere in between on a continuum from wide to narrow, depending on the desired wave shapes. For example, by making the device relatively wide, the device is more stable laterally, but additional hydrodynamic drag is created, and accordingly, any wave shapes created thereon will typically, as in the preferred embodiment, be directed laterally and/or outwardly, to create substantially upwardly and laterally flowing wave formations thereon. On the other hand, by making the device relatively narrow, the device is not as stable laterally, but hydrodynamic drag can be reduced, and therefore, any wave shapes created thereon will typically be directed upwardly and substantially rearwardly. Rather than producing surfable wave shapes, the relatively narrow embodiments are more likely to produce wakes, or enhanced wakes, over or through which wakeboarding maneuvers can be performed. The narrow configuration also allows the boat to travel at higher speeds, which can also affect the formation of the waves. The narrower configuration also requires less power to move through the water, and consequently, can be used by boats having less power.

While the device is preferably buoyant, the device does not necessarily have to be buoyant. In the preferred embodiment, at least the wave forming sections are buoyant, so that those sections can float at or near the water surface during operation. Even without buoyancy, however, the present invention can be configured so that the hydrodynamic forces acting on the device can cause the device to be self-aligned and travel substantially along the surface of the water. Together with the pivoting connection, which substantially fixes the device in relation to the boat in the lateral directions, the configuration of the device can help to keep the device in substantial equilibrium. Portions of the device can also be made buoyant, while other portions can be made non-buoyant, depending on the desired performance of the device. The wave forming sections, for example, in the preferred embodiment, are preferably buoyant to help them stay at or near the surface of the water. On the other hand, the center portion, which is intended to be submerged below the surface of the water in the preferred embodiment, may not have to be buoyant, and indeed, may be better off being non-buoyant, to provide a counteracting downward force on that portion of the device. The present invention contemplates using virtually any degree and variation of buoyancy that enables the device to perform in the intended manner.

In the embodiment that is attached to the boat hull, the device can be removably or substantially permanently secured to the side of the boat, or made integrally with the boat hull. The wave forming sections in this embodiment can be secured along virtually any part of the side of the boat hull, depending on the desired wave formations, boat performance requirements and the size and shape of the boat. The operable portion of the wave forming sections in this embodiment are similar in shape to the ones used in the preferred embodiment. They extend substantially laterally at an angle rearward and outward on the sides of the boat. They have flow forming surfaces and forward leading edge portions which help to lift water to form the desired wave shapes. The wave forming sections can be supported by a bracket which positions them slightly away from the boat hull, or they can be attached directly to the hull.

DETAILED DESCRIPTION OF THE INVENTION

The present invention is a wave generating device that is boat activated, such that it can be pulled by, or otherwise secured to, a motor boat, in a deep water environment, wherein, as the boat is operated, the device moves through the water, lifting up water to form wave shapes, such as tunnel waves, spilling waves, and/or, in some embodiments, enhanced wakes. Depending on the type of wave generating device being used, and consequently, the wave shapes that are formed, a rider can ride on, or otherwise maneuver about, the wave, or wake, performing various skimming, skiing, wake-boarding and/or surfing maneuvers thereon, which can, in some cases, simulate the thrill of surfing, or, in other cases, enhance the sport of wake-boarding.

While there are several embodiments disclosed herein, the basic concept of the present invention is a wave generating device that is boat activated, and which, by the power of the boat, is moved through the water, to create hydrodynamic effects which result in waves or enhanced wakes. The preferred embodiment and several others are designed to create surfable and/or ridable wave shapes in the water, while others are designed to create ridable wakes and enhanced wakes. In contrast to the sport of water skiing and wake-boarding, the preferred embodiment of the present invention can enable riders to "free" surf and perform other skimming maneuvers while riding and being propelled forward by the moving wave without the aid of a tow rope. While each of the disclosed embodiments may have common characteristics, there are also characteristics that are different and unique to each of the particular embodiments. The present invention is intended to include all of the embodiments and characteristics, as well as those that may not have been disclosed, which are nevertheless substantially consistent with the operation and function of the disclosed embodiments.

The Boat

The present invention is capable of being used with virtually any type of boat 2 or other self driven water vehicle in virtually any deep body of water at the convenience of the operator. Existing boats can be adapted so that the wave generating device can be removably or substantially permanently attached to the side of the boat or to the rear of the boat and pulled. New boats can also be created which have built-in wave generating devices, either integrally formed on the boat hull or otherwise attached to the boat. The attachment means can be customized or modularly manufactured so that the device can be removably and portably attached to a wide variety of different boat styles and sizes. Within the contemplation of the present invention there are virtually no limits on the size and character of the boats that can be used to drive the wave generating device. All that is required is that they have sufficient power to drive the wave generating device through the water at the appropriate speeds, as will be discussed.

The Preferred Embodiment

Figure 1:
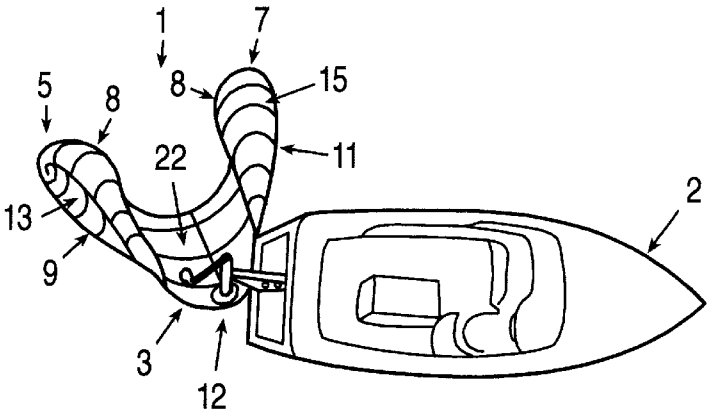
FIG. 1 shows one of the preferred embodiments with a boat from the top.
Figure 2:
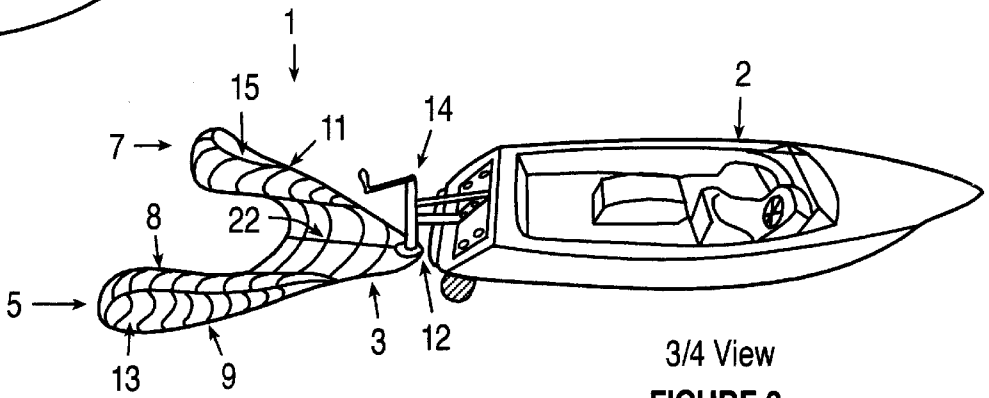
FIG. 2 shows a three-quarter view of one of the preferred embodiments.
Figure 3:
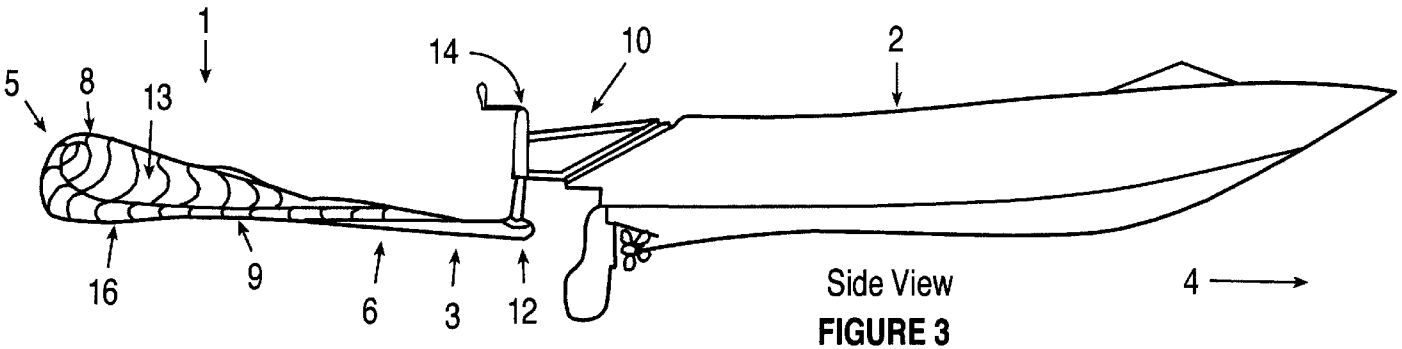
FIG. 3 shows one of the preferred embodiments from the side view.

As shown in FIGS. 1–3, the preferred embodiment is a boat activated wave generating device 1, that is substantially in the shape of a V from above. The device 1 has a forward extending center portion 3 which forms the apex of the V shape, from which the device is pulled by the boat 2. For purposes of this application, unless otherwise indicated, "forward" will be the direction that the device 1 travels through the water, as shown by arrow 4, and "rearward" will be the opposite direction.

Connected to the center portion 3 are preferably two substantially identical wave forming sections 5, 7 extending substantially laterally at an angle relatively rearward and outwardly from the apex of the center portion. The triangulation and symmetry, in plan view shape, of the device, and in particular the wave forming sections, is intended to enable the device, when pulled from the center, to encounter substantially equal hydrodynamic forces on either side of the wave forming sections, such that during operation, it self-aligns as it moves through the water. The preferred embodiment is preferably symmetrical, in plan view, for the reasons stated above, although asymmetrical shapes and wave forming sections that are not substantially identical are within the contemplation of the present invention.

a. The Connection

The connection of the device 1 to the boat 2 is preferably centered at the forwardmost apex of the center portion 3 for the reasons stated above. The connection is, in the preferred embodiment, capable of pivoting in at least one or more of the horizontal, vertical and torsional directions, but substantially fixed in the lateral directions. This can be accomplished by providing a strong, substantially rigid connecting member 10, extending from the back end of the boat, and providing a pivoting joint 12, such as a ball and socket, universal joint, or similar means, etc., as shown in FIGS. 1–3, extending therefrom, that can be removably connected to the device. Permitting the device to be removably connected in this manner makes it possible for the device to be easily attached and removed and therefore portable, i.e., used at the convenience of the operator.

Having a substantially fixed, but pivotable, joint 12 that prevents lateral motion helps reduce instability in the horizontal and vertical directions. For example, by fixing the joint in the vertical direction, the depth at which the device travels through the water can be controlled. Generally, the back end of the boat will be more stable than the front end of the boat, due to the greater effect of hydrodynamic forces on the front end. Accordingly, by pivotably connecting the device to the back end of the boat, and preventing the device from moving vertically in relation to the boat, the depth at which the device moves through the water can be substantially stabilized, and made substantially constant, allowing a consistent amount of water to flow onto the device. Under these conditions, it is possible for the device to lift a substantially constant amount of water onto the device, to create a sheet flow of water having a substantially constant depth, and substantially consistent wave shapes and wake formations thereon. Substantially fixing the joint 12 in the horizontal direction also helps to stabilize the device in the direction of travel so that it does not shift from side to side when encountering varying water surface conditions.

While the joint 12 can be substantially fixed in lateral directions, the connecting member 10 can, if desired, although not necessarily so, be provided with an adjustment means 14, to allow the position of the connecting joint 12, and therefore, the device 1, in relation to the boat, to be adjusted. By being able to adjust the position of the device in relation to the boat, the adjustment means 14 can help control, for example, the depth at which the wave forming sections 5, 7 travel through the water behind the boat. In this manner, the operator can adjust the position of the device in the water so that the device is placed in its optimum performance position, which can be a function of the size, weight, speed and power of the boat, the water surface conditions, etc. The adjustment means can also be used to adjust the depth of the device in relation to the boat when the weight inside the boat changes, i.e., when the number of persons on the boat changes or equipment is placed on or removed from the boat, etc. In addition, the adjustment means 14 can be provided with adjustments in other directions, such as side to side, or front to back, which may be desirable under certain conditions, to enable the boat and device to perform under optimum conditions, and to enable the riders to have enough room to perform the desired maneuvers on the wave shapes and wake formations behind the boat. Accordingly, the adjustment means 14 preferably has elements that slide, or otherwise move, in at least one or more of the lateral directions, i.e., up and down, forward and backward, and/or side to side, either by hand crank, hydraulically, pneumatically, mechanically, or by some other means. The adjustment means also preferably allows the connecting member 10 to be locked into position at the appropriate time, to allow the operator to make quick and easy on-the-spot adjustments, to customize the position of the device for optimum performance at any given time.

The pivoting connection 12 enables the boat 2 and device 1 to move independently with respect to each other in other than lateral directions, which helps the boat and device to perform with optimum speed and control. The ability of the device to pivot in the horizontal direction, as shown in FIG. 1, allows the device to follow immediately behind the boat in the line of travel, which substantially improves the ability of the boat and device to maneuver around turns. By allowing the device to follow in the line of travel, the wave forming sections 5, 7 of the device 1, which preferably extend outward further than the width of the boat, can also be positioned in open water. The ability of the device to pivot independently from the boat in the vertical direction allows the device to remain substantially level in the water even when the front of the boat moves up and down. When the boat accelerates or travels through rough water, the boat often planes or skims over the water, causing the front end of the boat to move up and down. By pivotally connecting the device to the back end of the boat, which typically remains more stable in the water, the device can be maintained in substantial equilibrium, substantially unaffected by the boat's front end movement. The ability of the device to pivot in the torsional direction allows the boat and device to lean independently from one another, which can be helpful around sharp turns. Because the preferred device is generally wider and has a relatively flatter base than the boat, when the boat pulling the device leans into a sharp turn, the boat is allowed to lean independently from the device, allowing the device to remain substantially level in the water despite the leaning of the boat. Even around sharp turns, therefore, the connection allows the device to remain in substantial equilibrium in the water.

b. The Center Portion

In the preferred embodiment 1, the forward extending center portion 3 forms the apex of the V shape, and extends outwardly and rearwardly to where it is connected to the wave forming sections 5, 7. In side view, as shown in FIG. 3, the center portion 3 is preferably relatively flat in configuration, or in the shape of a flat wedge. The relatively flat configuration of the center portion 3 makes it possible for it to travel substantially parallel to and below the water surface, allowing it to cut through the water directly behind the boat. The bottom 6 of the center portion is relatively flat, although not necessarily so, and acts as a hydrodynamic foil which allows the device to move through the water without creating significant hydrodynamic drag. The bottom 6 can also be provided with grooves or channels, preferably aligned in the direction of travel, to provide rigidity and assist in directing water onto which it travels rearward.

The water behind the boat can be turbulent due to the propellers and the egress of water from underneath the boat. The center portion, by cutting through the water, can help stabilize the device by directing that water rearward. In the preferred embodiment 1, the turbulent water flowing substantially along the surface of the body of water behind the boat is permitted to flow substantially onto the center portion 3. This can be accomplished by having the center portion positioned below the water surface level behind the boat. As discussed above, the depth at which the device can be positioned in the water in relation to the boat can, when desired, be adjustably controlled by the adjustment means 14 and connecting member 10. The center portion is preferably submerged under water to between about 6 to 24 inches in depth, although this amount can be higher or lower. Some of the water flowing behind the boat is allowed to flow onto the center portion so that water is channeled rearward between the wave forming sections 5, 7, to help self-align the device horizontally in the water. The present invention also contemplates center portions having other configurations, such as those that have a more complex shape, which provide the advantages described above.

The forward part of the center portion is preferably angled or cut back as shown in FIG. 1 so that it does not interfere with the back end of the boat during sharp turns, allowing the device to pivot freely in a horizontal direction to a maximum of about 90 degrees. Adjusting the adjustment means 14 and connecting member 10 so that the device is positioned further behind the boat can also accomplish this objective. The forward part of the center portion 3, nevertheless, extends near the boat's propellers to help guard the propellers and prevent accidental injuries. A guard member, not shown, can also be provided to specifically cover the propeller area for increased safely.

The back part of the center portion 3 can terminate somewhere near the back end of the wave forming sections 5, 7, but preferably someplace near the middle as shown. The top 22 and bottom 6 surface of the center portion 3 is preferably laterally oriented so that it does not create significant hydrodynamic drag. The surfaces are preferably smooth, but can have grooves and/or channels thereon as discussed. The center portion 3 can be slightly tapered and flattened in the shape of a tear drop in cross section to permit water flowing over and under it to transition smoothly during operation enabling the center portion to act as a hydrodynamic foil over the water. The size and shape of the center portion 3 in relation to the device overall can be a function of the need for the center portion to provide the hydrodynamic foil effect discussed above. The larger the surface area of the center portion 3, the greater the hydrodynamic foil effect, and the greater the stability it provides. On the other hand, if the center portion is too large, it may create undesirable hydrodynamic effects, such as increased hydrodynamic drag, which could adversely affect the performance of the boat and device. Additionally, the size and shape of the center portion 3 is a function of its ability to provide structural support for the wave forming sections 5, 7.

Figure 4:
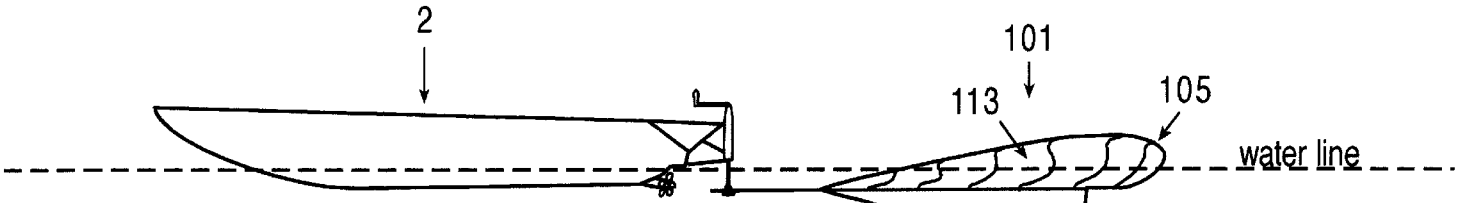
FIG. 4 shows a different version of the preferred embodiment from the side.
Figure 5:
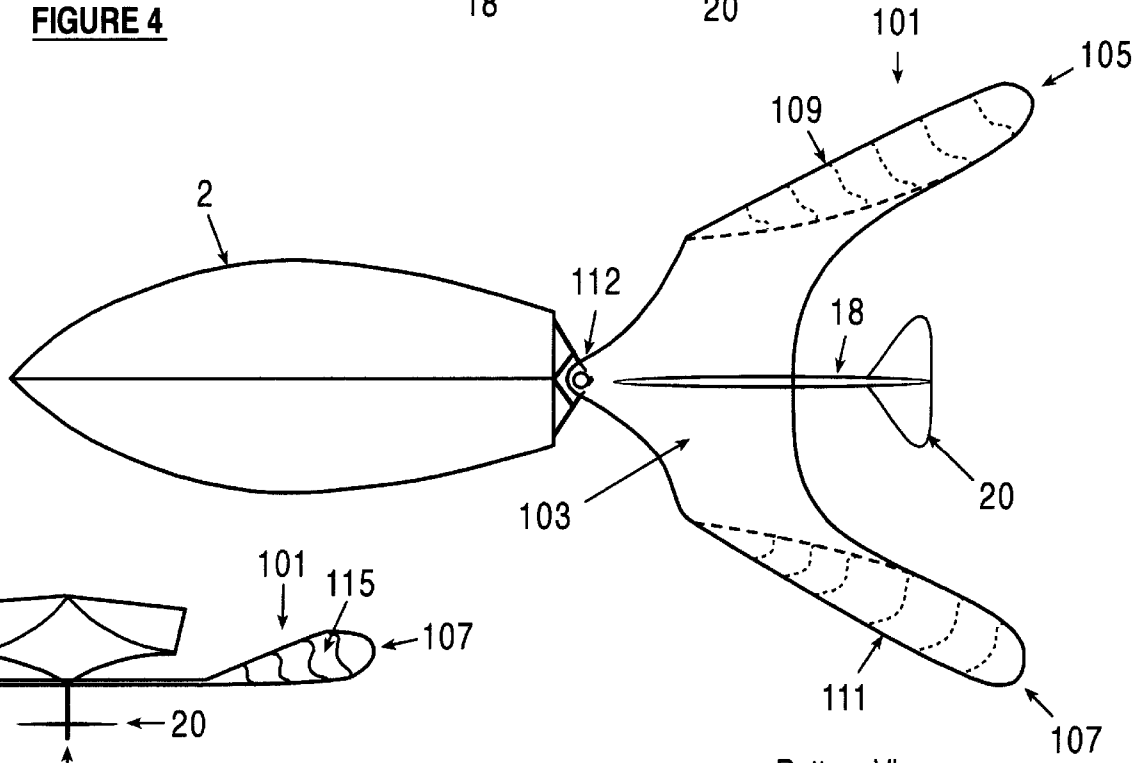
FIG. 5 shows a different version of the preferred embodiment from the bottom.
Figure 6:
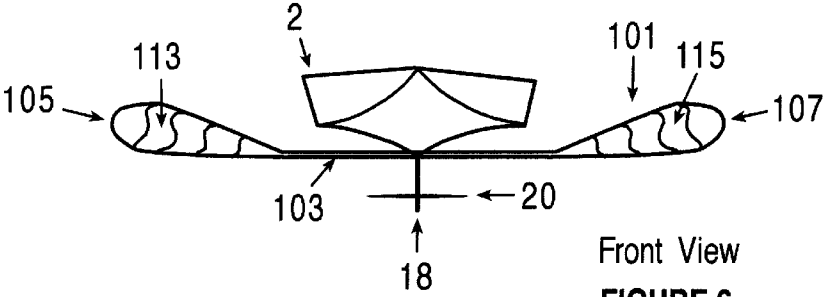
FIG. 6 shows a different version of the preferred embodiment from the front.

In a slightly different version of the preferred embodiment 101, shown in FIGS. 4–6, the center portion 103 is provided with one or more keel fins or rudder-like members 18, extending downwardly from the center portion, to help stabilize the device horizontally in the water. This additional stabilizing means can be provided where the device is relatively wide or large, as shown in FIG. 5, which may otherwise make the device less stable due to the possible effects of greater and more varied hydrodynamic conditions. It can also be provided where the device is relatively narrow, as shown in one of the alternate embodiments. The narrower the stance and smaller the support base, the harder it is to keep the device stable laterally and in the direction of travel, and therefore, the greater the need for additional stabilizers. As shown in FIGS. 4–6, the member 18 can be planar and extend substantially vertically downward in the fore/aft direction from the middle of the center portion 3. It can extend as far forward as the apex of the center portion and as far rearward as considerably behind the back part, as shown in FIG. 5, if desired. It can be curved along the bottom as shown or any other configuration that performs in the intended manner. If more than one member 18 is provided, the members are preferably extended downward from the center portion at an equal distance from the middle. A canard 20 can also be provided which extends substantially horizontally from the member 18 to provide additional vertical stabilization to the device.

The center proton 103 of this device 101 also extends forward to the apex where the pivoting connection 112 is located. The forward edge of the center portion 103 is also cut back to allow room for the device to turn without interfering with the back of the boat. As will be discussed later, the center portion 103 is wider in this embodiment, placing the wave forming sections 105, 107 further laterally outward into the open water.

c. The Wave Forming Sections

As shown in FIGS. 1–3, the wave forming sections 5, 7 extend substantially laterally at an angle rearward from the center portion, finishing the V shape from above. In the preferred embodiments, there are two substantially identical, but opposite facing, wave forming sections 5, 7, one on either side of the center portion. Each wave forming section has a forward leading edge 9, 11, which extends laterally along the outer edge of each section outwardly from the center portion 3. Extending upward from the leading edges and relatively rearward are the upper flow forming surfaces 13, 15 which, in the preferred embodiment, have a generally concave curvature. The present invention, however, contemplates flow forming surfaces having virtually any configuration to create virtually any wave shape.

The portion of the wave forming sections 5, 7 that actually lifts water onto the device, and therefore, must be submerged in the water during operation, is the forward extending leading edge portions 9, 11, which extend along the forward part of the sections, at an angle rearward from the center portion 3. While the leading edge portions are preferably slightly rounded in cross section, so that they do not cause injury to the riders, they are nevertheless substantially flattened or wedge shaped and laterally oriented, at least in the preferred embodiment, so that they perform the function of cutting through the water and lifting water upward onto the flow forming surfaces. During operation, the leading edge portions 9, 11 are positioned slightly below the water surface, preferably at between 6 to 24 inches below the average surface level of the water, although this range can be higher or lower. This enables the leading edge to create an advancing pressure field which causes water to lift and either "break" like a conventional wave, or, at higher speeds, to form a sheet flow of water that substantially conforms to the flow forming surfaces. If the flow forming surface is relatively shallow, the pressure field can also create a flow of water that travels at a speed with a Froude number less than one. By keeping the depth of the leading edge in relation to the water surface substantially constant, the leading edges 9, 11 can effectively create a constantly breaking wave, or, pare a substantially constant amount of water onto the flow forming surfaces, to form a stably shaped sheet flow of water having a substantially constant depth substantially upward and/or laterally onto the flow forming surfaces 13, 15.

Generally, the upper flow forming surfaces 13, 15 are curved to cause water flowing thereon to substantially conform thereto, and create the desired wave shapes. The flow forming surfaces can be provided with virtually any configuration to achieve the desired wave shapes and wake formations. For example, to form tunnel wave shapes, as in the preferred embodiment, the upper flow-forming surfaces are curved and concave in shape, vertically and horizontally, so that a theoretical infinitesimal body of water, moving along the face of the surfaces, encounters a force, which is primarily vertical and forward, as it travels along its face. This force, or pressure field, accelerates the water, forcing it not only upward and forward, but laterally, above the surrounding body of water, whereafter, the force of gravity can overcome its upward and forward momentum and cause it to fall in a curving arc, back to the base of the advancing wave. If the forward speed of the water relative to the flow-forming surface is sufficient, its path will form a substantial loop, forming a tunnel wave shape similar to those that exist in nature, on which surfing and other skimming maneuvers can be performed.

The angle at which the flow forming surfaces are oriented horizontally in relation to the direction of travel can be anywhere from as little as 5 degrees to as high as 70 degrees, but preferably about 20 to 50 degrees. The angle of the wave forming sections will determine the character of the wave shapes and wake formations that are created. The higher the angle of orientation, the greater will be the lateral forces acting on the flow of water, creating a more laterally directed wave shape. These laterally directed wave shapes are typically steeper in pitch and shorter in length. On the other hand, the lower the angle of orientation, the less will be the lateral forces acting on the flow of water, creating a more rearwardly directed wave shape. Hydrodynamic drag can also be affected in this manner. Accordingly, the selection of the angle of orientation must take into consideration various factors, including the speed and power of the boat, the desired wave shapes, etc.

The angle of vertical inclination of the flow forming surfaces and degree of curvature will also affect the trajectories of the water flowing thereon. By having relatively steep inclined surfaces, the flow forming surfaces will cause the water flowing thereon to be lifted substantially upward, creating more defined forward moving tunnel wave shapes thereon, while also creating greater hydrodynamic drag. In such case, the power needed to drive the device through the water is greater, and therefore, boats having sufficient power will be needed. By having relatively shallow inclined surfaces, on the other hand, in combination with a greater horizontal angle of orientation, the flow forming surfaces will cause the water flowing thereon to be lifted substantially laterally across the surfaces, forming laterally flowing curling wave shapes thereon. Even if the incline is shallow, if the angle of horizontal orientation is great enough, it will be possible to create curling wave shapes thereon. If both the incline and horizontal angle of orientation is low or shallow, however, it may not be possible to create the desired curling wave shape on the flow forming surfaces, although other wave shapes may be created. Some forward directed component, in either the horizontal or vertical directions, is needed to create the tunnel wave shapes. For additional description of the wave generator hulls, and other pertinent aspects of the present invention, reference can be made to several related applications, U.S. application Ser. Nos. 08/475,092; 08/393,071; 08/074,300; U.S. Pat. Nos. 5,236,280; 4,954,014; and 4,792,260, the relevant portions of which are incorporated herein by reference. In other embodiments, the flow forming surfaces can be in virtually any configuration that will perform in the intended manner, including but not limited to, those that are inclined and curved in one of either the horizontal or vertical directions, substantially concave in some areas and convex in others, substantially planar and inclined to some degree, convex and rounded in shape like a bulb or torpedo, and/or in any combination of these or other shapes, as well as virtually any configuration that achieves the desired results.

In certain embodiments, including the preferred embodiment, it may be desirable to make the vertical incline and/or horizontal angle of the wave forming sections 5, 7, in relation to the direction of travel, adjustable during operation so that optimum performance conditions can be created. Water conditions, as well as the speed at which the device travels through water, will have an effect on the formation of the wave shapes, and therefore, it may be desirable, such as during acceleration, in particular, to gradually change the angle of the wave forming sections, in horizontal and/or vertical directions, and therefore, of the flow forming surfaces 13, 15 and leading edges 9, 11, to optimize the performance of the device at any given time. The horizontal adjustability can be provided by adding pivoting or hinge-like elements and/or sliding groove members or any other similar means in between the wave forming sections 5, 7 and center portion 3 which will allow the wave forming sections to be adjusted in relation to the center portion during operation quickly and efficiently. Vertical adjustability can also be provided by adding similar adjustment means to allow the angle of the flow forming surfaces 13, 15 to be adjusted in relation to the wave forming sections 5, 7 and/or the center portion 3. The adjustment means can be powered hydraulically, pneumatically, mechanically, or by any similar method, to allow the operator to modify the position of the wave forming sections. Indeed, the adjustment means can be computer programmed so that it automatically adjusts to the changing water conditions and speed of the boat to create the optimum wave shapes and wake formations at any given time.

The spacing of the wave forming sections depends on several factors, including the desired water effects, the power and width of the boat being used, etc. Because there is turbulence created by the boat's propellers and the egress of water from underneath the boat in the preferred embodiment, to ensure that very little turbulent water immediately behind the boat is encountered by the wave forming sections, the spacing is preferably far enough apart so that the wave forming sections are substantially in open water during operation. A relatively wide stance or base created by spacing the wave forming sections relatively far apart also helps to provide lateral stability as the device moves through the water which also improves the quality of the wave shapes being formed. The spacing is also preferably wide enough in the preferred embodiment so that the wave forming sections are positioned such that, at the appropriate speeds, the device will cross paths with the boat's wake, which spreads outwardly behind the boat, resulting in merging the boat's wake and the wave formed by the device, to create an enhanced wake formation, upon which wake boarding type maneuvers can be performed. In the preferred embodiment, to create ideal wave shapes in open water, the wave forming sections are preferably positioned about as far apart as the width of the boat or slightly more. The relatively wide spacing ensures the proper hydrodynamic effect not only on the wave forming sections 5, 7, but also on the center portion 3. The wide spacing, however, creates additional hydrodynamic drag, and requires the boat to have sufficient power to reach the optimum speeds. In other embodiments, where it may not be as important for the wave forming sections to be positioned in open water, such as in the narrow alternate embodiments, they may be spaced closer together.

The embodiment shown in FIGS. 4–6 is relatively wider than the embodiment of FIGS. 1–3, wherein the wave forming sections 105, 107 are positioned further laterally outward than the width of the boat, which not only improves the water flow conditions on the wave forming sections, but also helps to stabilize the device laterally in the water. The device 101 of FIGS. 4–6 is otherwise similar to the embodiment of FIGS. 1–3 in that the basic configuration of the device is triangular, the center portion 103 is substantially laterally oriented and flat in configuration, and the wave forming sections 105, 107 extend substantially laterally at an angle rearward from the center portion. The curvature of the wave forming sections 105, 107, including the flow forming surfaces 113, 115 and leading edges 109, 111, are also substantially similar.

Lastly, as shown in FIG. 3, the upper edge 8 of the wave forming sections 5, 7 are preferably rounded and convex in shape so that any water that is not directed upward and laterally by the flow forming surfaces flows down the back side of the sections. The rounded surface also helps to prevent injury in case a rider spills and falls backward onto the top edge. The bottom 16 of the wave forming sections are preferably substantially laterally oriented so that during operation there is minimal hydrodynamic drag. The bottom surface 16 of the sections are preferably an extension of the bottom surface 6 of the center portion 3, i.e., the bottom can be smooth or have grooves and/or channels. The back bottom edge of the wave forming sections can also be rounded and inclined upward, as shown in FIG. 3, to allow water over which the sections travel to be transitioned upward to the surface so as not to cause excessive hydrodynamic turbulence and backflow.

d. The Construction Materials

The present invention can be made of virtually any strong resilient material, such as fibre-glass, carbon graphite composite, metal, plastic, wood, etc., or any combination of the above. Because of the hydrodynamic forces that will be exerted on the device, particularly the shear and moment forces acting on the device as it moves through the water, it is important that the materials used and the design chosen be strong enough to withstand these forces.

Reinforcing materials can be inserted throughout the body of the device, and reinforcing shapes, such as angular construction, can be used, to provide maximum strength at the minimum cost and weight. The preferred body is one that can be injection molded into shape, such as fibre-glass or plastic. Preferably, on the outside of the device, particularly on the top and forward sides, there is a soft padding, made of any conventional material, like polyurethane foam, which provides cushioning for safety purposes. Also, preferably coated on the outside of the device is a water proof, low friction material, such as rubber, plastic, etc., which seals the outside surface and provides flow enhancement to the device.

The preferred embodiment of the device is preferably made buoyant so that it can independently float in the water at the appropriate level in the water. Nevertheless, because the device is, in the preferred embodiment, connected to the boat in a manner that will only allow rotational movement, as opposed to lateral movement, it does not necessarily have to be buoyant. The speed of the boat can also cause hydrodynamic forces to act on the device to help stabilize the device and maintain it level in the water. Nevertheless, to provide buoyancy where needed, the body can be inserted or otherwise injected with air pockets or foam or other buoyant material. The body can also be made hollow so that the buoyancy of the device can be adjusted merely by inserting or withdrawing additional materials, such as water, etc., from the body. This may be helpful in being able to fine tune the buoyancy of the device to suite the particular desires and needs of the operator, i.e., the depth of travel in the water.

The present invention is preferably able to be installed on virtually any kind of boat, including but not limited to fishing boats, tug boats, cabin cruisers, high speed water ski boats, catamarans, jet ski's, high speed sail boats, multi-hull catamarans, sail driven boats, and single rider vehicles. Although the size, shape and weight of the invention must be properly adapted to the particular boat to which it is attached, the wave generating device of the present invention is preferably able to enhance and/or otherwise be made to work with virtually any existing and future design.

Operation of the Preferred Embodiment

To operate the preferred embodiment, the device 1 and boat 2 can be positioned in the water and connected using the connecting members 10, 12. The device, prior to acceleration is preferably positioned behind the boat, and substantially level in the water. A tow rope, such as one used in water skiing, can be used by the rider, so that as the boat accelerates, the rider can be pulled behind the boat. At the same time, the rider can hold onto a riding board, such as a surf board, body board, skim board, wake board, water ski, etc., and maneuver into place, and when sufficient velocity is reached, the rider can either let go of the rope, and begin to perform free maneuvers on or around the wave shapes being created by the device, or, use the rope to perform wake board or water ski type maneuvers on the wave shapes and wake formations created by the device.

During acceleration, the hydrodynamic forces preferably help to stabilize the device 1 in the water, helping to keep it substantially level, and at a substantially constant depth in the water behind the boat. The buoyancy of the materials and the planing effect of the bottom surface help to create an upward force which is countered by the weight of the device and the downward force created by lifting water onto the wave forming sections and to some extent the center portion. The balancing of the forces is assisted by the position of the device in the water in relation to the rear of the boat which is held in place by the connecting member 10. The pivoting connection 12 allows the device to rotate independently in the horizontal, vertical and torsional directions, while preventing movement in the lateral directions, to help prevent instability in the horizontal and vertical directions. Even if the boat's front end begins to move up and down due to acceleration or rough water, the rear of the boat will tend to stay relatively stable, allowing the device to be maintained in a relatively stable state behind the boat. The triangulation of the device also helps to maintain the device in substantial equilibrium.

Figure 7:
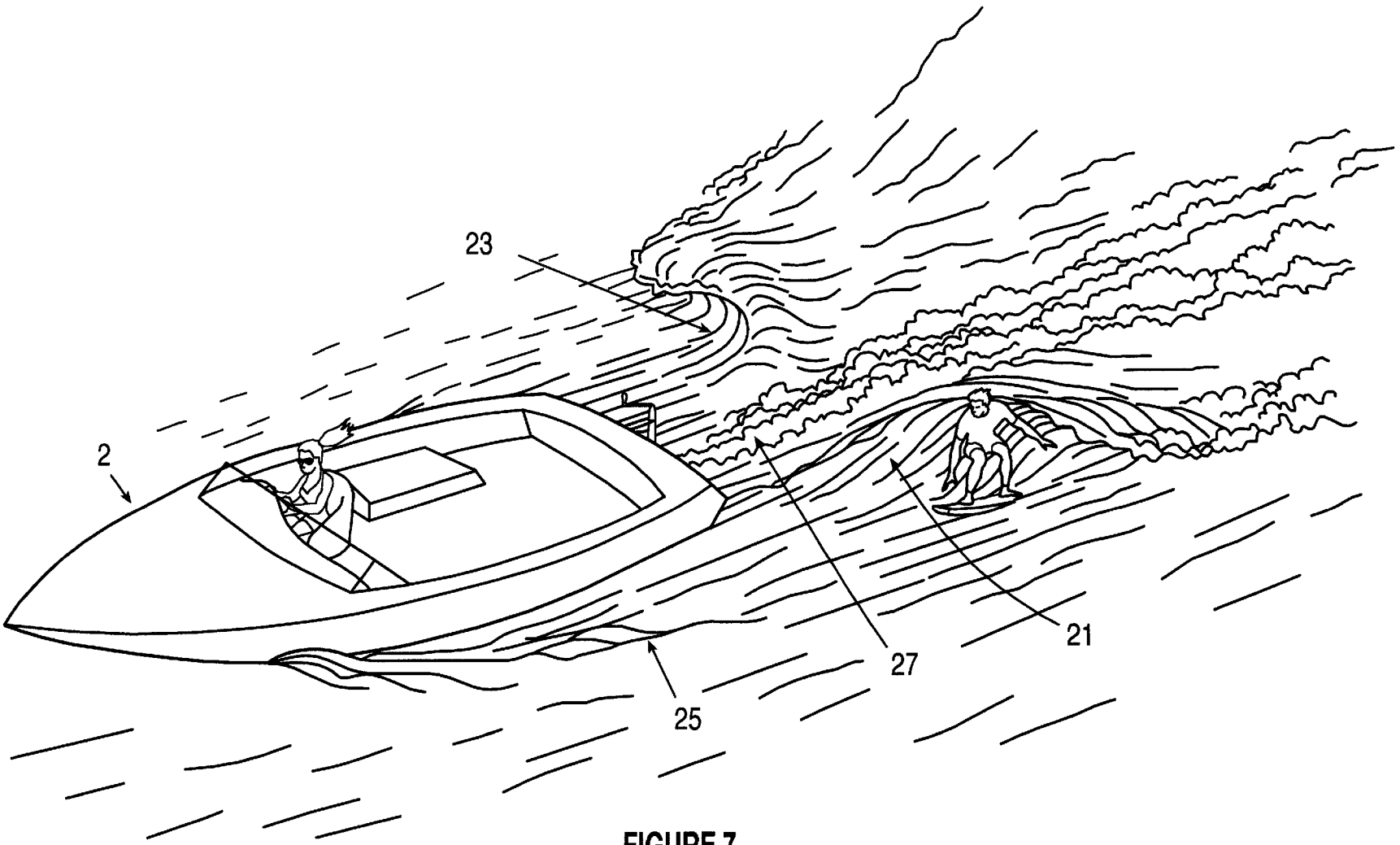
FIG. 7 shows the preferred embodiment in operation.

As the boat moves through the body of water, as shown in FIG. 7, it creates a wake 25 which spreads outwardly to the side of the boat 2 and rearward. At relatively slow speeds, this wake spreads out in front of the device. When the boat accelerates to higher speeds, the boat's wake spreads out, but the device travels fast enough to encounter the boat's wake, preferably causing the boat's wake to merge with the wave formed by the wave generating device. This merger, or wave augmentation, creates an enhanced wake or larger wake spreading outwardly behind the boat, on which free surfing and/or teathered wake boarding type maneuvers can be performed. The augmented wake or wave is larger than the ordinary unaugmented wave created by the device, due to the merging of the energies from the two wakes/waves, and therefore, can be an ideal condition for creating surfable wave shapes 21, 23. When the boat travels at even higher speeds, the wake tends to wrap around the boat and elongates rearwardly in relation to the boat, as the boat outruns the outward spreading of the wake, so that no merger of the boat's wake and the device's wave will occur.

The speed of the boat, when changed, will, as discussed, cause different wave shapes and wake formations to form. Accordingly, riders of different abilities and preferences can change the speed of the boat, and therefore, the device, to change the type and/or character of the wave shapes and/or wake formations that are created at any given moment. In addition, the position of the device, in relation to the boat, as discussed above, can be changed, such as the depth of the device, which can change the performance of the device. Of course, the device itself can also be custom modified, such as providing greater or lesser spacing between the wave forming sections, or changing the angle of horizontal and/or vertical orientation of the flow forming surfaces, or changing the configuration of the device, etc., to change the character of the wave shapes and/or wake formations, all of which are within the contemplation of the present invention.

At sufficient speeds, which is preferably about 6 to 25 miles per hour, the water in front of the wave forming sections is lifted onto and substantially across the flow forming surfaces, causing a flow of water to conform to the surfaces, forming a curving shaped wall of water which rises up the incline, and moves laterally across the surface to form a loop, and, due to gravity, falls onto the advancing wave, creating a tunnel wave shape thereon. At this moment, the rider can maneuver on, about or inside the advancing wave, while being propelled forward by the inclined slope of the wave, without having to be pulled by the rope, which can be let go. The rider can also perform teathered wake boarding maneuvers on the waves formed by the device while being pulled by the rope. Another advantage of the present invention is that when the speed of the boat is relatively slow, the boat's wake can actually make the rough water calmer in an area immediately in front of the wave forming sections, so that the device can travel through relatively calm water, which helps to create more consistent wave shapes.

In operation, the preferred embodiment of the present invention is preferably designed so that the center portion 3 is positioned below the surface of the water to permit water to flow thereon. The downward pressure caused by water flowing onto the center portion can counter the upward pressure caused by the buoyancy of the material and/or the hydrodynamic planing effect on the device. Because the center portion 3 is directly behind the boat, the turbulent water 27 behind the boat flows directly behind the boat and through the center portion of the wave generating device, away from the wave forming sections which are located on the outer ends. This helps channel the rough water directly in a rearward direction which also helps to stabilize the device in the forward direction. It also helps to prevent the device from planing over the water, particularly during acceleration.

Figure 8:
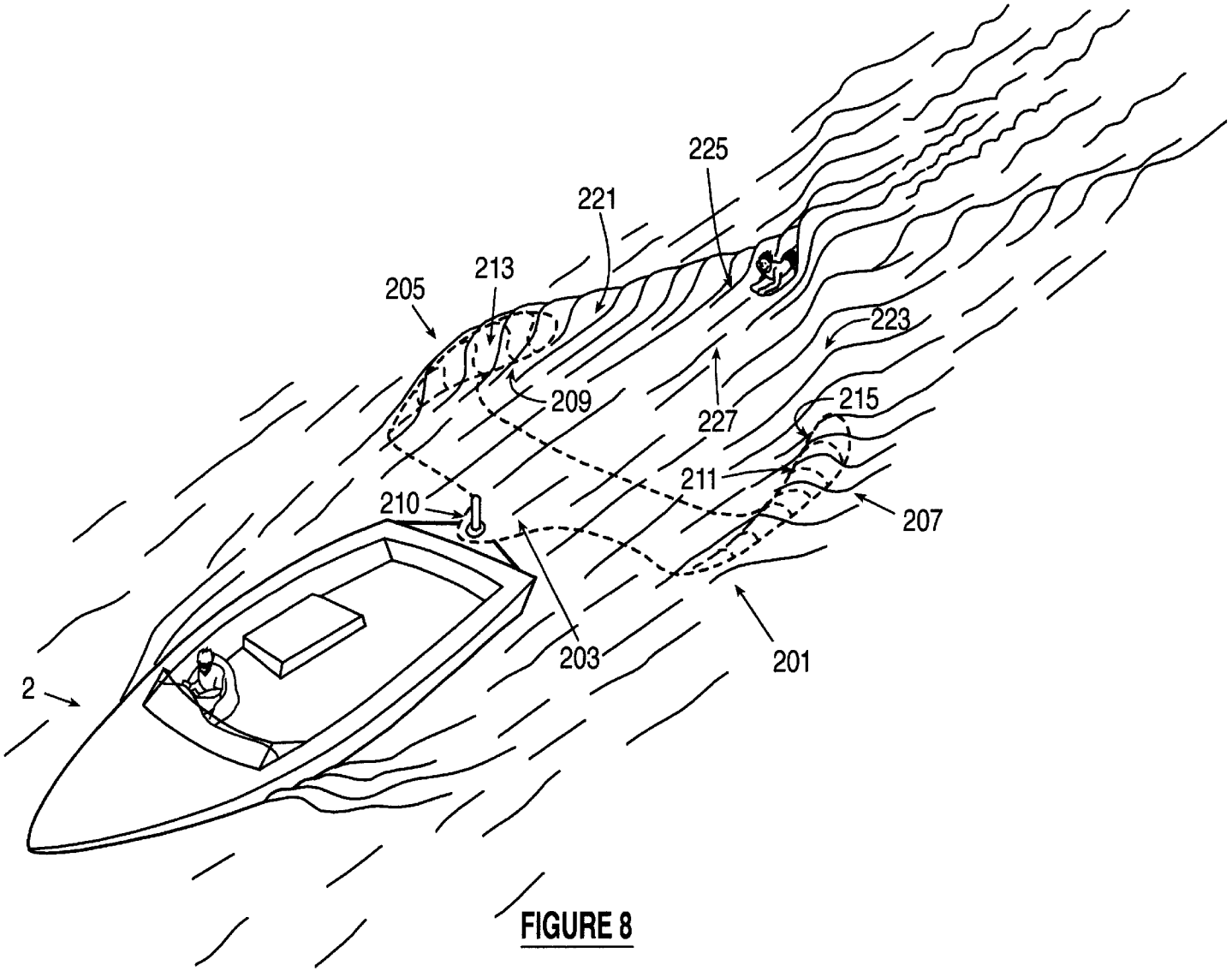
FIG. 8 shows an alternate embodiment with inverted wave forming sections.

The Embodiment shown in FIG. 8

The embodiment 201 of FIG. 8 is substantially similar to the embodiments of FIGS. 1–6 in that it has a pivoting connection 210 and a substantially wide center portion 203 that is relatively flat in configuration, with two wave forming sections 205, 207 extending therefrom. The wave forming sections 205, 207 in this embodiment, however, are inverted, and spaced farther apart, such that a portion of the water flowing onto the center portion 203 is directed rearward and then onto the wave forming sections 205, 207, wherein the flow forming surfaces 213, 215 thereon are oriented inwardly to cause the water to flow upward and laterally inward back toward the center of the device. By positioning both wave forming sections in this manner, water flowing onto the flow forming surfaces is directed inwardly to create two wave shapes 221, 223, which travel inwardly and intersect, crossing over behind the boat, creating a forward moving vortex-like wave shape 225 in the middle, upon which surfing maneuvers can be performed.

In this embodiment, the wave forming sections 205, 207 are positioned on the center portion 203 such that the center portion acts as part of the forward leading edge to cause water to be lifted upward onto the device 201. The inverted wave forming sections 205, 207 extend rearwardly and inwardly and therefore also have leading edges 209, 211 on the back end of the sections which also help lift water upward. As in the previous embodiments, device 201 has wave forming sections with flow forming surfaces 213, 215 extending upward thereon to cause the water to be directed upwardly and/or across inwardly. Rather than having curvatures that create tunnel wave shapes thereon, however, the flow forming surfaces 213, 215 in device 201 preferably create wave shapes that do not curl over and break, but form large swells and wakes, which extend inwardly toward the center, as shown in FIG. 8.

The wave forming sections 205, 207 are preferably spaced far enough apart so that the forward end of each section is outside the width of the boat and in open water. In this manner, the flow forming surfaces 213, 215 can effectively scoop up water from outside the boat's line of the travel, rather than behind the boat, which can be turbulent. The flat configuration of the center portion 203 helps to smooth out the turbulent water flowing in a rearward direction behind the boat so that the water through which the rider travels 227, which is in front of where the wave shapes 221, 223 converge, is relatively calm. This embodiment otherwise can be constructed in the same manner as the previous embodiments and operated in substantially the same manner.

Figure 9:
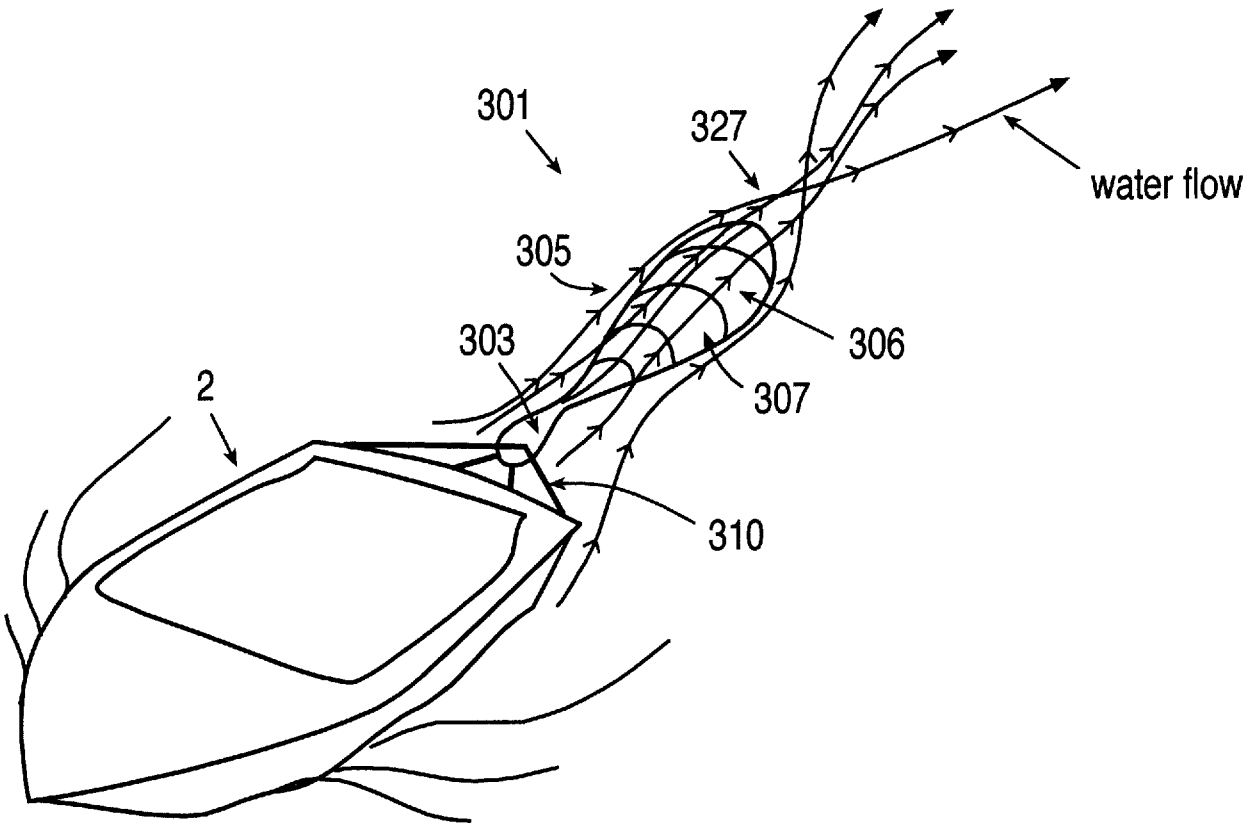
FIGS. 9–10 show another alternate embodiment with a bulbous displacement hull.
Figure 10:
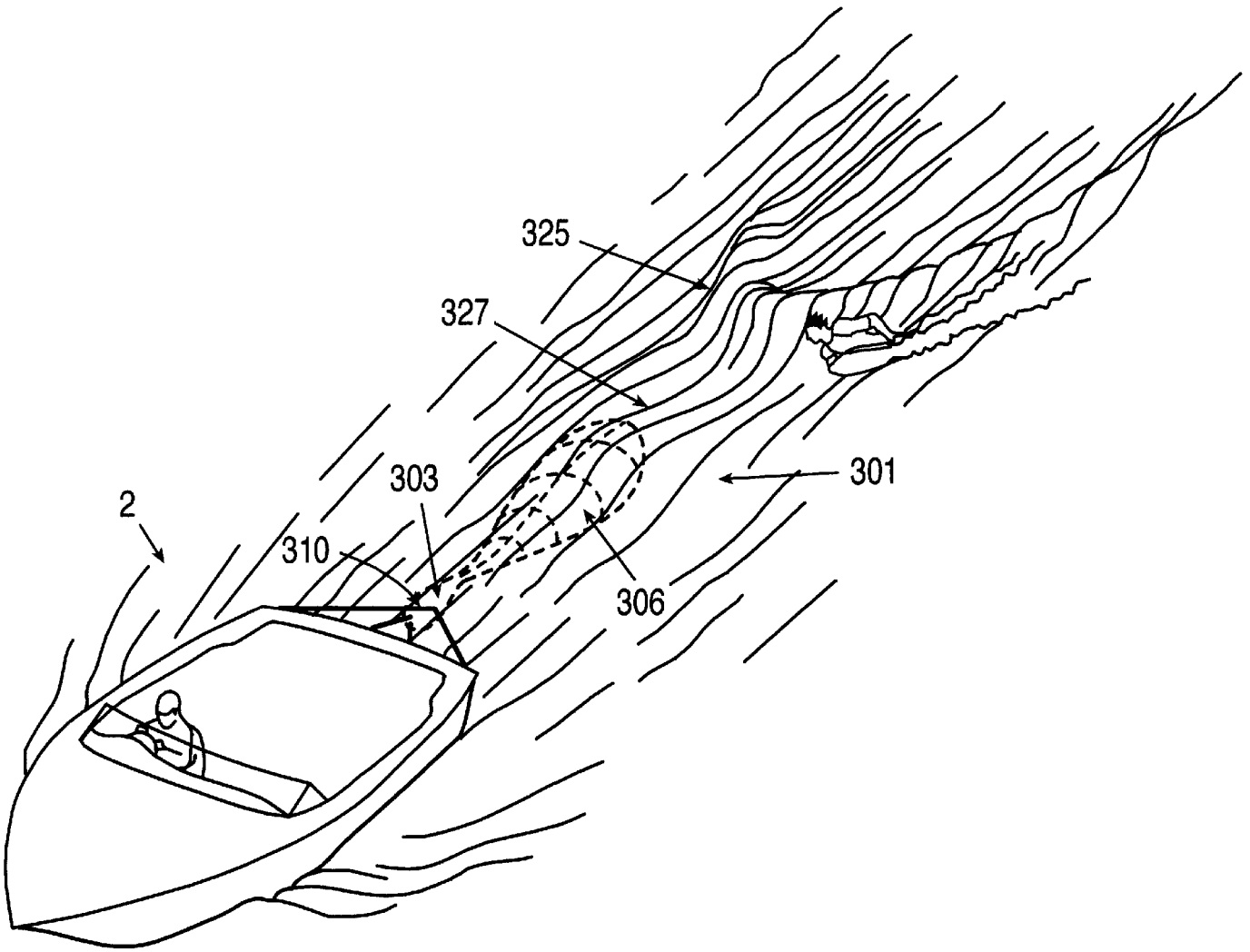

The Embodiment shown in FIGS. 9–10

This embodiment 301, shown in FIGS. 9–10, is considerably different in shape from the previous embodiments, although it is also preferably triangular in design for self-alignment purposes. This embodiment 301 is substantially more narrow and compact in design, so that it forms simple wave shapes and wake formations thereon, and has wave forming sections 305, 307, which extend predominantly in the rearward direction, and are not as well defined as in the previous embodiments. The entire device is in the shape of a substantially bulbous displacement hull 306 wherein the wave forming sections have flow forming surfaces and rounded leading edges that cause water to be lifted and displaced, as shown in FIGS. 9–10, substantially rearwardly. The flow forming surfaces can have curved surfaces which cause water to be pushed upward and rearwardly in relation to the device and/or across the surfaces. The surfaces can be both concave and convex in shape, if desired, although not necessarily so. The concave shape, for example, can be toward the front of the wave forming sections to help scoop up water onto the device. The convex shape can be toward the back of the sections to push water upward and substantially over the device. The outer surface of the device 301 is preferably curved and substantially smooth so that it reduces hydrodynamic drag, which allows the boat and device 301 to travel at relatively high speeds.

In this embodiment 301, the forward connection 310 preferably provides a slightly more rigid connection in relation to torsional movement than in the other pivoting connections discussed above, which helps keep the device 301 substantially level in the water. The narrow configuration and support base of the device 301 provides less lateral stability on its own, and therefore, preferably requires stabilization through other means. When the connection 310 in this embodiment does not pivot in directions other than horizontal, the forward end 303 of the device 301 is preferably, although not necessarily, flattened and made flexibly rigid, so that that portion of the device can bend but resist twisting. In this manner, the device 301 can flexibly rotate independently of the boat in vertical directions, while having limited rotating capabilities in the torsional direction, which helps to give additional stability to the device. Some rotational movement in all directions is nevertheless preferable so that the boat and device can perform well around turns.

In operation, as shown in FIG. 10, water flowing over and around the device 301 is directed substantially upwardly and/or pushed laterally to the side and displaced, creating a low pressure field 327 immediately behind the device. The water's natural tendency to fill the void created by the low pressure field causes water behind the device to flow inwardly, as shown in FIG. 9, creating a vortex-like wave shape 325, as shown in FIG. 10, crossing and following immediately behind the device. This crossing pattern creates a forward moving swell 325, upon which surfing and other skimming maneuvers, including teathered wake boarding type maneuvers, as shown, can be performed.

Because this embodiment is narrower, it can be accelerated faster, and can travel at higher speeds, due to the reduced hydrodynamic drag caused by the device. Higher speeds are also well suited to performing the teathered wake boarding type maneuvers which are possible on this embodiment. While the preferred embodiment preferably travels no more than about 25 miles per hour to form ideal tunnel wave shapes, this embodiment can travel at speeds of up to about 40 miles per hour. Another advantage is that boats having less power and therefore less costly boats can be used to operate this embodiment.

Figure 11:
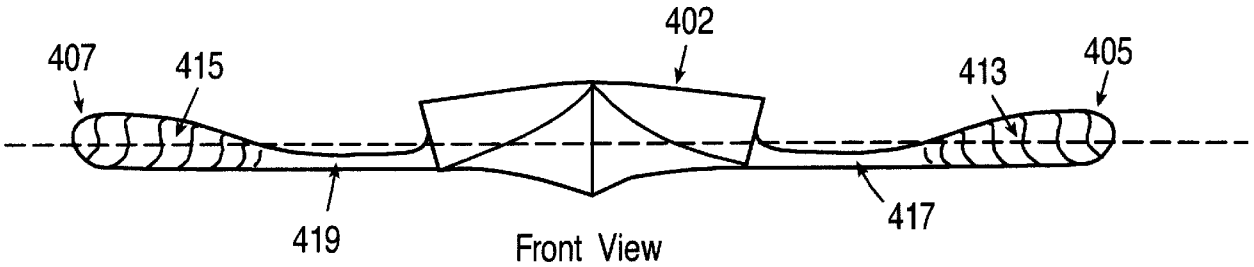
FIGS. 11–12 show another alternate embodiment affixed to the side of the boat hull.
Figure 12:
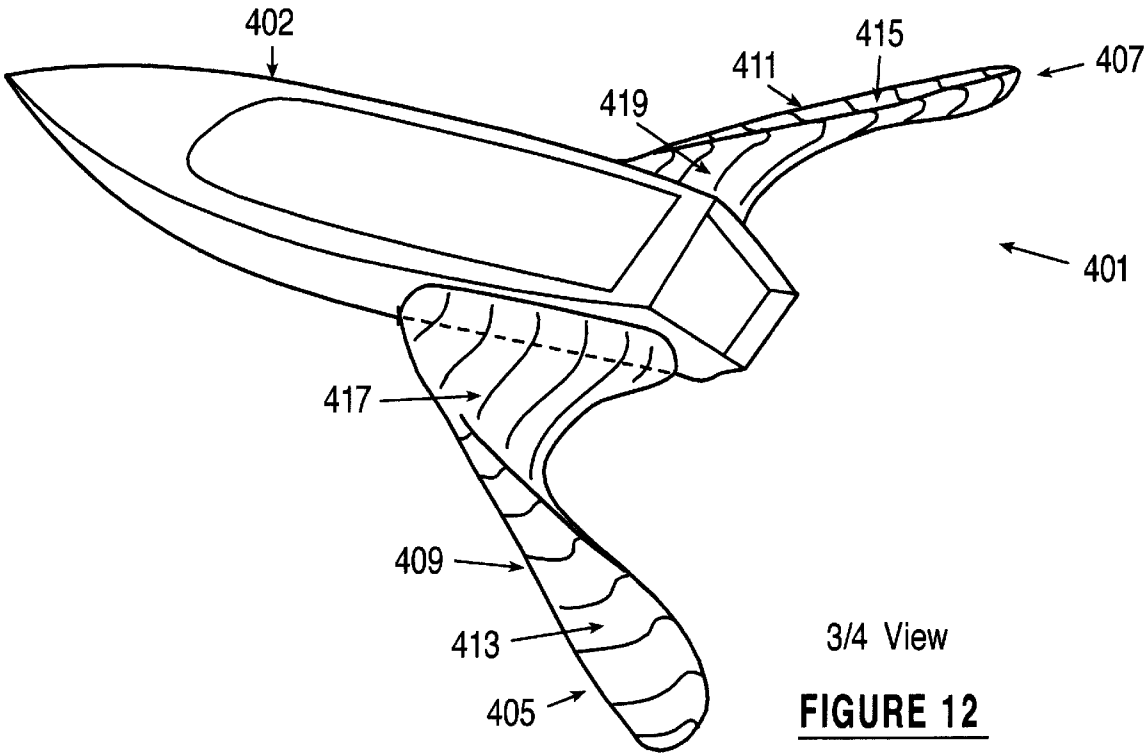

The Embodiment shown in FIGS. 11–12

This embodiment 401 shown in FIGS. 11–12 has elements that are similar to the ones shown in FIGS. 1–6, except that the device 401 is attached to the boat 402 directly rather than pulled. In this embodiment, the boat itself acts to help stabilize the device in the water, and in effect replaces the center portion of the previous device 1. The attachment of the device 401 to the boat is also preferably symmetrical to create, as in the preferred embodiment, a triangulation effect which helps to balance the hydrodynamic forces acting on the device and stabilize it in the water.

The operable portions of the wave forming sections 405, 407 in this embodiment are similar in shape to the ones of FIGS. 1–6 discussed above. The sections extend substantially laterally at an angle rearward and outward from the sides of the boat hull. They have flow forming surfaces 413, 415 and forward extending leading edge portions 409, 411, which extend substantially horizontally to help lift water onto the flow forming surfaces to form the desired wave shapes.

The wave forming sections can be supported by extended support members 417, 419 which can be extended outwardly to position the sections slightly away from the boat hull, or they can be attached directly to the hull. The support members 417, 419 are preferably substantially flat and positioned parallel to the water surface and submerged during operation so that hydrodynamic drag is reduced. These support members, which extend from both sides of the boat, act in much the same manner as the center portions discussed previously, in that they provide a hydrodynamic foil effect over the water.

This embodiment can be removably or substantially permanently secured to the side of the boat, or made integrally with the boat hull. The wave forming sections can be located virtually anywhere along the side of the boat, depending on the size and shape of the boat, the desired wave formations, and the performance requirements of the boat. The location where the device is attached to the boat is preferably structurally reinforced to strengthen the connection between the device 401 and boat 402. This helps ensure that the device can withstand the additional shear and bending forces that will be applied to the boat hull at the point of connection.

The position of the device 401 in relation to the boat is preferably such that, as in the previous embodiments, the leading edges 409, 411 remain substantially at a constant depth in the water during operation. Preferably, the wave forming sections 405, 407, as in the previous embodiments, are positioned so that the leading edges 409, 411 are consistently at approximately 6 to 24 inches below the surface of the water. This is accomplished by taking into consideration not only the weight and buoyancy of the device, but also the weight and buoyancy of the boat to which the device is rigidly connected. The wave forming sections 405, 407 and other parts of the device 401 can be made buoyant, although not necessarily so, so that they provide a wide stance and help to keep the device level in the water.

The performance of the embodiment 401 is affected by several factors. Because the wave generating device is affixed or otherwise attached to the boat, the performance of the device is to a great extent a function of the hydrodynamic performance characteristics of the boat. And because the wave generating device can have an effect on the manner in which the boat travels through the water, the combination of the size, shape, curvature, angle, buoyancy and weight of the wave generating device must be coordinated with the size, shape, curvature, angle, buoyancy and weight of the boat, to provide the optimum conditions under which ideal wave shapes can be formed. Ideally, the wave generating device will be designed in a manner that will cause it to create the wave shapes without significantly affecting the overall stability of the boat in the water. Because the wave generating device is intended to cut and push through the water, the goal is to design the device so that it actually improves the stability of the device and boat in the water, as opposed to altogether preventing any effect by the device on the performance of the boat.

An important consideration therefore is the depth at which the forward extending leading edges 409, 411 travel through the water. This is because the depth at which the forward extending edges travel through the water determines the thickness and consistency of the flow of water flowing onto the upper flow-forming surfaces. When the depth of travel is substantially constant, the wave generating device can lift a substantially consistent amount of water onto the flow-forming surfaces and form wave shapes having a substantially consistent thickness and shape. When the depth fluctuates, however, the amount of water being lifted onto the flow-forming surface varies to create inconsistent flows and wave formations.

The many factors that can affect the depth of the device 401 in the water during operation are preferably taken into consideration in the design of the present invention. For example, because the buoyancy and weight of the boat and wave generating device taken together will affect the depth at which they float in a static water environment, buoyancy and weight must at a minimum be accounted for so that the forward extending leading edges 409, 411 are positioned at a predetermined level beneath the surface of the body of water. In this way, the start position of the boat will automatically cause the leading edges to be in the proper position, and therefore, will improve the overall operational performance of the device 401.

In addition, when the boat is in motion, particularly at high speeds, hydrodynamic forces can act upon the device to affect the position of the boat 402 relative to the water, and therefore, the relative position of the wave generating device 401. Accordingly, the boat and wave generating device must be adapted, hydrodynamically, to enable the boat to remain at a substantially constant depth and fore/aft angle in the water. In this respect, the size and shape of the device, and its position relative to the boat hull, in addition to its buoyancy and weight, must be adapted to stabilize the depth and angle at which the device moves through the water. It may be difficult for a high speed boat, which is designed to plane over the water surface during acceleration, and cause the front end of the boat to move up and down, to be maintained in an equilibrium position in the water. Careful placement of the wave generating device on certain types of boats and boat hulls can, however, successfully enable the boat and device together to remain substantially at an equilibrium depth in the water.

The boat's wake can affect the formation of the waves, and therefore, the position of the device 401 in relation to the boat 402 is preferably such that the wave forming sections 405, 407 either enhance the boat's wake, and/or, at sufficient speeds, do not encounter the boat's wake. For example, when the device 401 is positioned toward the back of the boat, as shown in FIG. 12, the wave forming sections 405, 407 are preferably positioned outwardly away from the boat hull so that when the boat is traveling at low speeds, the sections travel through the boat's wake, enhancing them to create larger wakes upon which wake boarding maneuvers can be performed. At relatively high speeds, however, the position of the device 401 shown in FIG. 12 makes it possible for the boat's wake to wrap around the side of the boat, through the space created by the support members 417, 419, which is between the wave forming sections 405, 407 and the boat hull, so that the wave forming sections travel through open water, rather than the boat's wake. When the device 401 is positioned toward the front of the boat, however, it is preferable to position the wave forming sections directly onto the boat hull, as the wave forming sections will be in open water.

The support members 417, 419 can be attached substantially anywhere along the side of the boat hull depending on the desired water effects. When attached near the front of the boat, for example, the wave generating sections push or otherwise plow water in front of the boat. The triangulation of the forces acting on the angled flow-forming surfaces can help to direct the boat properly. Nevertheless, because this will increase hydrodynamic drag, the maneuverability of the boat, particularly during turns, can be affected somewhat. Although the boat in this embodiment is preferably of a kind that will not plane excessively during acceleration, the forces acting on the flow-forming surfaces can also help to keep the front end from lifting and/or planing, provided that they are positioned low enough in the water to cut through rather than skim over the water.

When attached near the middle of the boat, the wave forming sections are likely to perform in a manner similar to the boat. However, steering the boat under these conditions can be made more difficult, requiring additional steering mechanisms, such as larger rudders, which can be installed to offset this condition. Although the wave forming sections are designed to push and scoop up water during use, due to the central position of the sections, they can cause hydrodynamic conditions which are less triangular, which can throw off the equilibrium of the boat.

The boat 402 is preferably large enough that the boat will be relatively stable in the water. Because the device 401 is rigidly attached to the boat, unlike the previous embodiments which can pivot, it is more important that the boat itself remain substantially stable in the water during operation. Larger boats tend not to be affected as much by the movement and condition of the water surface, so they are ideal for this embodiment. The boat must also be powerful enough to drive the device 401 through the water without creating adverse hydrodynamic conditions which may affect the stability of the boat and device 401.

In operation, preferably, as in the previous embodiments, the device 401 is moved through the water by the boat, such that a substantially constant amount of water is caused to be lifted onto the flow forming surfaces 413, 415, so that consistent wave shapes and wake formations are created. Water can be directed upwardly and/or laterally across the surfaces creating curling tunnel wave shapes thereon and enhanced wake formations, similar to the ones described above.

Figure 13:
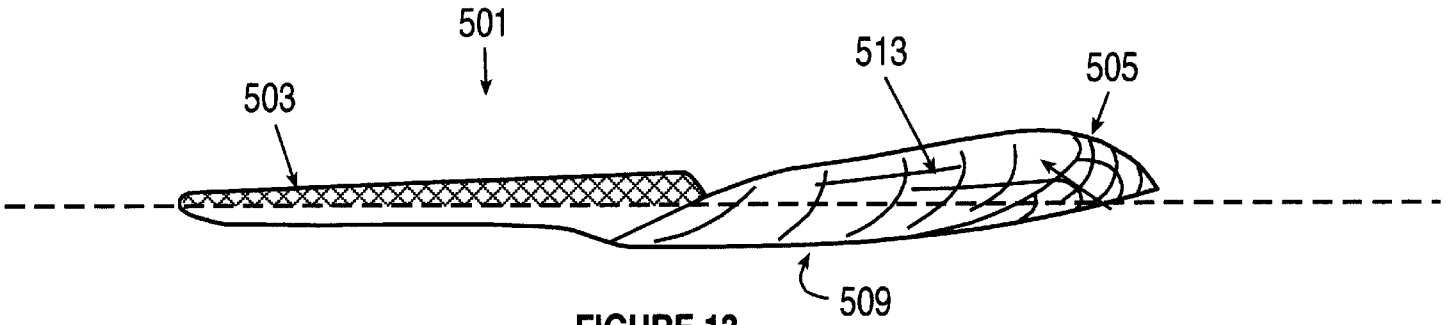
FIGS. 13–14 show another alternate embodiment with an elongated center portion.
Figure 14:
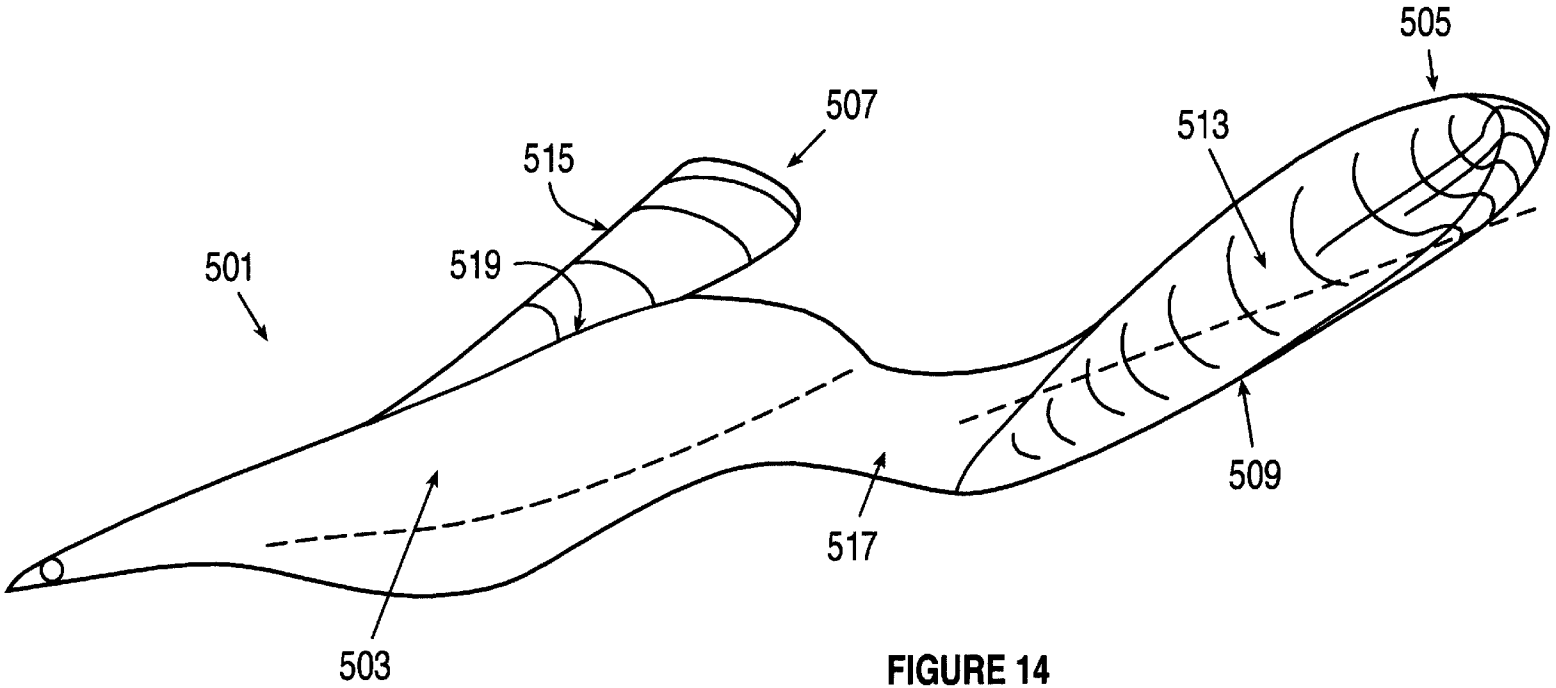

The Embodiment shown in FIGS. 13–14

This embodiment represents another version which is a variation of the embodiment shown in FIGS. 1–6. Although this embodiment is preferably also symmetrical and triangular for self-alignment purposes, it shows that the present invention can have various complex configurations. For example, the center portion 503 in this embodiment is more wedge shaped and elongated and designed to plane or skim over the water surface. The wave forming sections 505, 507 also extend outward laterally and rearwardly at an angle from extended support members 517, 519, which connect the center portion 503 to the wave forming sections 505, 507. The wave forming sections have forward leading edges 509, 511 and upper flow forming surfaces 513, 515, as in the previous embodiments. The flow forming surfaces are also preferably curved and concave in both horizontal and vertical directions to create tunnel wave shapes thereon, although not necessarily so.

As shown in FIG. 13, the top of the center portion is preferably designed so that it can be partially above water, rather than submerged during operation, contrary to the embodiment of FIGS. 1–6. In this embodiment, because the center portion 503 is designed to skim over the water, rather than under water, the wave forming sections 505, 507 must be positioned slightly lower in relation to the center portion, as shown in FIG. 13, so that the forward leading edges 509, 511 are submerged and lift water upwardly onto the flow forming surfaces 513, 515. The center portion 503 and wave forming sections are also preferably buoyant, although not necessarily so, to cause the device 501 to ride substantially along the surface of the water. The buoyancy of the center portion helps to keep it at or near the water surface. Because of the complex shape of this embodiment, it is preferably injections molded in construction and integrally formed.

In operation, water from behind the boat is diverted by the center portion 503 outwardly, and over the support members 517, 519. Open water is pared by the leading edges 509, 511 and lifted upward onto the flow forming surfaces 513, 515. The water is then directed in a manner similar to the water in the previous embodiments to create the desired wave shapes and wake formations thereon.

Explanation of Wide to Narrow Continuum of Embodiments

Figure 15:
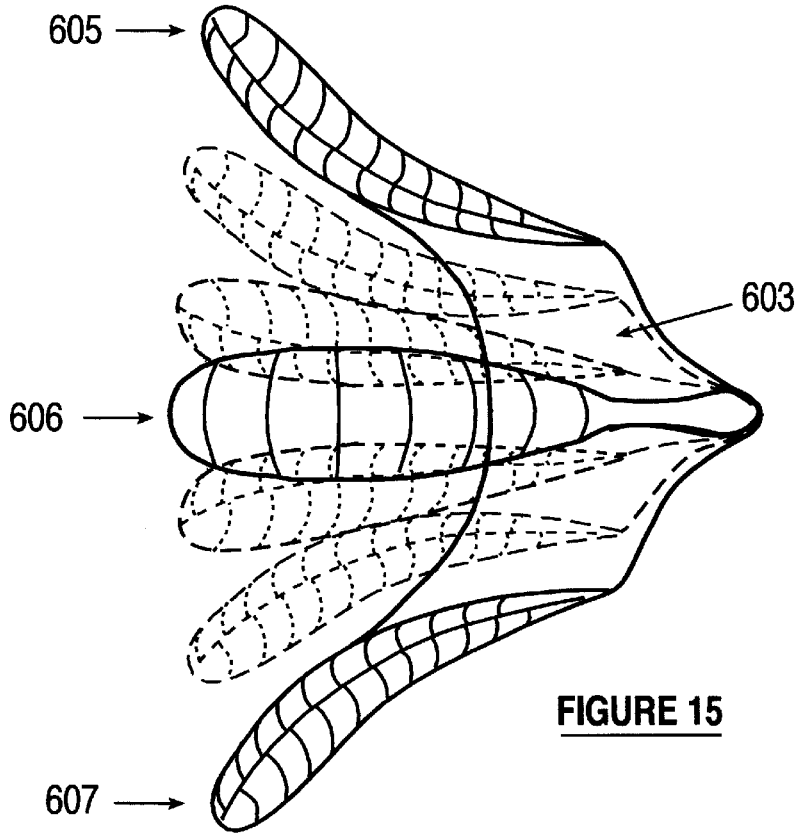
FIGS. 15–16 show several embodiments along a wide to narrow continuum.

The present invention contemplates a continuum of embodiments extending from wide embodiments, like the one shown in FIGS. 4–6, to narrow embodiments, like the one shown in FIGS. 9–10. Some examples of embodiments, seen from the top view, on such a continuum are diagramatically shown in FIGS. 15 and 16. FIG. 15, for example, shows a continuum wherein the widest embodiment, similar to the one shown in FIGS. 4–6, has wave forming sections 605, 607, angled outwardly and rearwardly from a relatively wide center portion 603. The next embodiment on the continuum, shown in dashed lines next to the first one, is a slightly narrower embodiment which has a slightly narrower center portion 603 and otherwise has similar wave forming sections 605, 607, although the angle at which the sections are oriented in relation to the direction of travel is slightly less. The next embodiment on the continuum, again shown in dashed lines, is an even narrower device with only a very narrow center portion 603 and wave forming sections 605, 607 that extend substantially rearwardly with very little outward extension. Finally, in the center of the continuum is a single bulbous displacement hull 606, like the one shown in FIGS. 9–10. This embodiment is much like, in effect, the product of two wave forming sections 605, 607, merged together and rearwardly oriented, rather than laterally, to form a single wave forming section or bulbous displacement hull 606, in the center extending rearward, without a center portion extending therebetween.

Figure 16:
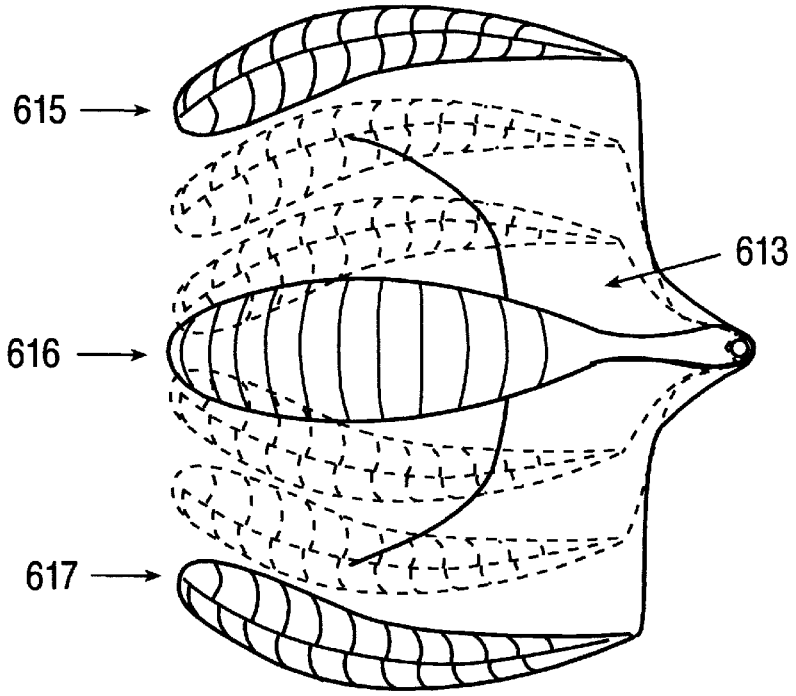

In the other continuum, shown in FIG. 16, embodiments having inverted wave forming sections 615, 617, similar to the ones shown in the embodiment of FIG. 8, are provided. This continuum begins with an embodiment, much like the one shown in FIG. 8, with the wide center portion 613 extending substantially laterally and outwardly, and inverted wave forming sections 615, 617 connected to the ends of the center portion and extending rearwardly and inwardly therefrom. The next embodiment, shown in dashed lines next to the first one, is similar but narrower, and the inverted wave forming sections are not quite as inverted or inwardly directed in relation to the direction of travel. As in the previous continuum, the embodiments on this continuum become progressively narrower, until the inverted wave forming sections 615, 617 are merged together to form, in effect, a single bulbous displacement hull 616, although in this continuum, the wave forming sections that make up the bulbous displacement hull are slightly inverted.

Continuums like the ones shown in FIGS. 15–16 can be created to apply to virtually any design or embodiment of wave generating devices, such as those that have been discussed above, as well as those that have not been specifically shown but nevertheless are contemplated in the present invention. That is, virtually any design that can be produced within the scope of the present invention can be made relatively wide or narrow, in the manner shown in the continuums, to adapt to virtually any size or shape of boat. The continuums should be viewed as being exemplary, diagramatically, not as a limitation, of the varied shapes and sizes contemplated by the present invention.

The continuum is also helpful in showing the variations in the width of the device which can be used to create varying size wave shapes and/or wake formations for riders having different abilities and preferences. For example, for riders who want to surf or otherwise maneuver about a tunnel wave shape, the width of the device is preferably such that it augments the boat's wake, as discussed above. In such case, the wave forming sections, which augment the boat's wake, are preferably positioned far enough apart, so that they extend outside the width of the boat, so that the device can encounter the boat's wake in open water. On the other hand, for riders who want to perform wake boarding type maneuvers, the device should be more narrow, on account of the need for higher speeds, and on the need for creating wake formations which travel more rearwardly, than laterally.

Single embodiments which have adjustable configurations along the continuum are also within the scope of the present invention. That is, a single device can, if desired, be modularly constructed so that the angle of orientation of the wave forming sections, or the lateral extension of the center portion, and therefore, the spacing of the wave forming sections, etc., can be adjusted, so that one or more of the embodiments shown on the continuum can be formed from a single device. The different embodiments, for example, can be modularly constructed having two wave forming sections which can be positioned and affixed at various angles onto different locations along center portions having varying widths and shapes. In this manner, a single device can be adapted to be used on boats of varying sizes and shapes, and perform in various ways, depending on the preferences of the operator.

What is claimed is:

1. A wave/wake generating device for use in a body of water to be activated by a boat, comprising:

a body having a forward extending center portion and a wave forming section on either side of said center portion extending substantially rearwardly and laterally outward therefrom, wherein each of said wave forming sections has a forward leading edge and at least one flow forming surface thereon, wherein each of said flow forming surfaces has an upwardly and forwardly facing concave curvature thereon;

a pivoting connector for connecting said device to said boat, said connector being provided on or near said center portion; and wherein said wave forming sections are adapted such that, as the device is pulled by said boat substantially along the surface of said body of water, the forward leading edge of each of said sections is at least partially submerged in said body of water and causes water to be lifted onto said wave forming sections, and upwardly and laterally across said flow forming surfaces, thereby creating various wave and/or wake formations in said body of water.

2. The device of claim 1, wherein the body is substantially buoyant and has two substantially identical wave forming sections extending at an angle from the center portion, wherein the device forms a substantial V shape from above.

3. The device of claim 1, wherein the device is removably connected to said boat.

4. The device of claim 1, wherein the position on which said pivoting connector is located on said boat is adjustable.

5. The device of claim 1, wherein at least two wave forming sections are provided and spaced apart with the center portion extending therebetween, and wherein said sections are inwardly angled with respect to the boat's direction of travel to cause at least a portion of the water flowing over said center portion to flow onto the flow forming surfaces, and substantially upwardly and inwardly, creating wave formations in the water that extend inward and cross over each other behind the boat.

6. The device of claim 1, wherein at least one rudder or keel member is provided which extends downward from said device, and at least one canard is provided which extends substantially horizontally from said rudder or keel member.

7. The device of claim 1, wherein said body is made of a strong resilient material, and is at least partially covered by a soft padding and a smooth protective coating.

8. A vehicle for use in a body of water, comprising:

a boat having a back end;

a wave/wake generator having a body adapted to be propelled substantially along the surface of said body of water in a predetermined direction, wherein the body has at least one substantially laterally extended section that has a substantially lateral and upward facing surface thereon, and wherein the extended section has a forward leading edge which is angled relative to the direction of travel;

a pivoting joint for connecting said wave/wake generator to said back end of said boat; and wherein, as the vehicle is propelled substantially along the surface of said body of water, the forward leading edge becomes substantially submerged below the surface of said water and causes water to be lifted up onto the extended section, wherein water flows onto the lateral and upward facing surface, and is acted upon both horizontally and vertically such that various wave and/or wake formations are created thereby.

9. The vehicle of claim 8, wherein the generator has a center portion that extends substantially laterally and has thereon on each side an extended section, wherein each of said extended sections has a rearwardly extended curved surface thereon, wherein each curved surface has a concave curvature in the horizontal and vertical direction.

10. A wave/wake generating device for use in a body of water to be activated by a boat, comprising:

a body having at least one substantially curved wave generator hull thereon, wherein the wave generator hull extends substantially laterally and upwardly therefrom;

a pivoting connector for connecting said body to said boat; and wherein, as the device is acted upon relative to the body of water, water that is substantially on the surface of said body of water is lifted up onto the wave generator hull to create a flow of water that is acted upon both laterally and upwardly, relative to the generating device such that wave shapes and/or other wake formations upon which maneuvers can be performed are created thereby.

11. The device of claim 10, wherein said body is made of a strong resilient material, and is at least partially covered by a soft padding and a smooth protective coating.

12. The device of claim 10, wherein the body is substantially buoyant.

13. The device of claim 10, wherein the body has a center portion and two substantially identical wave generator hulls extending at an angle from the center portion, wherein the device provides a triangulation of hydrodynamic forces acting on the device, to help maintain the device in substantial equilibrium.

14. The device of claim 10, wherein the pivoting connector can be removably connected to said boat.

15. The device of claim 10, wherein the pivoting connector is adjustable in relation to said boat.

16. The device of claim 10, wherein at least two wave generator hulls are provided and spaced apart with a center portion extending therebetween, and wherein said hulls are inwardly angled with respect to the boat's direction of travel to cause at least a portion of the water flowing between said hulls to flow substantially upwardly and inwardly, creating wave formations in the water that extend rearward and inward and cross over each other behind the device.

17. The device of claim 10, wherein the body is in the shape of a bulbous displacement hull, which helps to lift up and/or displace water, such that a low pressure field is created immediately behind said device during operation, which causes water flowing behind said body to flow inward toward the center, crossing over behind the device, forming a vortex-like wave shape upon which maneuvers can be performed.

18. The device of claim 10, wherein at least one rudder or keel member is provided which extends downward from said device.

19. The device of claim 18, wherein said at least one rudder or keel member has extending therefrom at least one substantially horizontally oriented canard.

20. The device of claim 18, wherein the body has a forward extending center portion that is substantially flattened to permit bending but substantially avoid twisting.

* * * * *